US011789375B2

(12) United States Patent
Yagyu

(10) Patent No.: US 11,789,375 B2
(45) Date of Patent: Oct. 17, 2023

(54) ELECTROSTATIC CHARGE IMAGE DEVELOPMENT TONER

(71) Applicant: ZEON CORPORATION, Tokyo (JP)

(72) Inventor: Sakyo Yagyu, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 317 days.

(21) Appl. No.: 17/271,719

(22) PCT Filed: Aug. 30, 2019

(86) PCT No.: PCT/JP2019/034270

§ 371 (c)(1),
(2) Date: Feb. 26, 2021

(87) PCT Pub. No.: WO2020/045664

PCT Pub. Date: Mar. 5, 2020

(65) Prior Publication Data

US 2021/0318633 A1 Oct. 14, 2021

(30) Foreign Application Priority Data

Aug. 31, 2018 (JP) ..... 2018-162557
Aug. 31, 2018 (JP) ..... 2018-162561
Jun. 27, 2019 (JP) ..... 2019-120219

(51) Int. Cl.
*G03G 9/087* (2006.01)
*G03G 9/097* (2006.01)
*G03G 9/08* (2006.01)

(52) U.S. Cl.
CPC ..... *G03G 9/09733* (2013.01); *G03G 9/0821* (2013.01)

(58) Field of Classification Search
CPC ..... G03G 9/08797; G03G 9/0825; G03G 9/08711; G03G 9/08737; G03G 9/08708
See application file for complete search history.

(56) References Cited

U.S. PATENT DOCUMENTS

2013/0309603 A1 11/2013 Takahashi et al.
2018/0149989 A1 5/2018 Suzuki et al.
2020/0233326 A1 7/2020 Yagyu

FOREIGN PATENT DOCUMENTS

JP 2000-267338 A 9/2000
JP 2004-258429 * 9/2004 ..... G03G 9/087
(Continued)

OTHER PUBLICATIONS

Translation of JP 2010-085841.*
(Continued)

*Primary Examiner* — Peter L Vajda
(74) *Attorney, Agent, or Firm* — WHDA, LLP

(57) ABSTRACT

The present invention provides a toner for electrostatic-image development comprising a color resin particle containing a binder resin, a colorant, a charge control agent, and a release agent, and an additive having a polydiene structure, wherein the additive having the polydiene structure has a solubility in styrene at a temperature of 40° C. of 3 to 40 g/100 g, when a cross section of the color resin particle is observed by a transmission electron microscope (TEM), the number of crystal domains of the release agent having an aspect ratio in a range of 2 to 10 in a field of view of 2 μm×2 μm square of the cross section of the color resin particle is 2 to 30.

13 Claims, 1 Drawing Sheet

(56) References Cited

FOREIGN PATENT DOCUMENTS

Figure 1A:
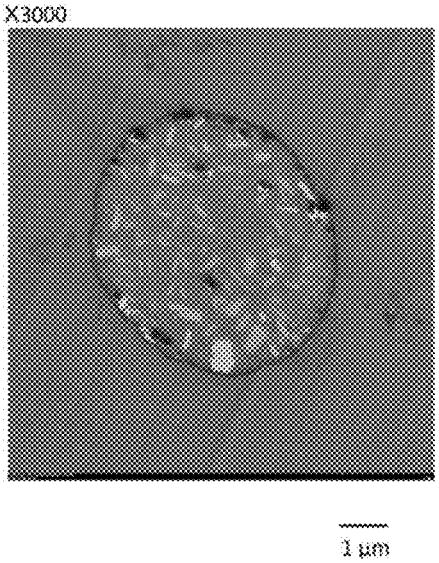

| | | | | | |
|---|---|---|---|---|---|
| JP | 2004-258429 | A | | 9/2004 | |
| JP | 2006-139172 | A | | 6/2006 | |
| JP | 2009-122171 | A | | 6/2009 | |
| JP | 2010-085841 | | * | 4/2010 | ..... G03G 9/087 |
| JP | 2010-85841 | A | | 4/2010 | |
| JP | 2011-248108 | A | | 12/2011 | |
| JP | 2012-177914 | A | | 9/2012 | |
| JP | 2014-35462 | A | | 2/2014 | |
| JP | 2016-206454 | A | | 12/2016 | |
| JP | 2018-92139 | A | | 6/2018 | |
| JP | 2019-12188 | A | | 1/2019 | |
| WO | 2019/065868 | A1 | | 4/2019 | |

OTHER PUBLICATIONS

Translation of JP 2004-258429.*
International Search Report dated Nov. 26, 2019, issued in counterpart International Application No. PCT/JP2019/034270 (2 pages).
International Preliminary Report on Patentability (Form PCT/IB/373) issued in counterpart International Application No. PCT/JP2019/034270 dated Mar. 2, 2021, with Form PCT/ISA/237 (14 pages).

* cited by examiner

ELECTROSTATIC CHARGE IMAGE DEVELOPMENT TONER

TECHNICAL FIELD

The present invention relates to a toner for electrostatic-image development used for developing an electrostatic latent image in electrophotography, electrostatic recording, electrostatic printing, and the like.

BACKGROUND ART

A method of forming an electrostatic latent image on a photosensitive member and developing the electrostatic latent image with a toner for electrostatic-image development into a desired image has been widely used in image forming apparatuses such as electrophotographic apparatuses, electrostatic recording apparatuses, and electrostatic printing apparatuses, and such apparatuses are applied to copiers, printers, fax machines, multifunction machines thereof, and the like.

For example, in an electrophotographic apparatus using electrophotography, usually, the surface of a photosensitive member composed of a photoconductive substance is uniformly charged with a variety of means, and an electrostatic latent image is formed on the photosensitive member. The electrostatic latent image is then developed with (a) toner (developing step), and the resulting toner image is transferred onto a recording material such as paper as needed (transferring step). The toner is fixed onto the recording material by heating or the like (fixing step) to obtain a printed material.

Among these steps for image formation, the fixing step usually requires heating of a fixing roll to 150° C. or more during fixing, leading to a large amount of consumption of electricity as an energy source. To this, recent demands for energy saving and higher speed printing of the image forming apparatus have been increasing, and accompanied by this, there has been a demand for design of a toner which can maintain a high fixing rate even if the fixing temperature is reduced (toner having excellent low-temperature fixing property).

In response to the above request, there have been proposed a method of lowering the glass transition temperature (Tg) of a toner, a method of containing a low melting point resin and/or a low molecular weight resin in a toner, a method of containing a low softening point substance (release agent) having a releasability (peelability) such as wax in a toner, and the like.

However, when the low-temperature fixing property is improved, the temperature of the fixing roll can be set to be low at the time of fixing, but when the toner is used at a high temperature or when the toner is left (stored) for a long period of time, fusion (blocking (aggregate)) between the toner particles tends to occur, and thus, the toner storage property may be deteriorated. For this reason, the design of the toner requires the development of a toner that can improve the low-temperature fixing property without impairing the storage property and reduce the power consumption, considering the storage property, which is a property contradictory to the low-temperature fixing property.

For example, Patent Document 1 discloses a black toner having a toner particle containing a binder resin, a crystalline material, and a black colorant, wherein in a cross section of the toner particle observed by a transmission electron microscope, when the major diameter of the cross section of the toner particle is R (μm) and the major diameter of the domain of the crystalline material is r (μm), for the cross section of the toner particle in which R (μm) satisfies $4 \leq R \leq 12$, the domain of the crystalline material satisfying the following formula (i) is domain A, and the number of the domains A per cross section of one toner particle is 20 or more and 300 or less.

$$5.0\times10^{-4} \leq r/R \leq 7.0\times10^{-2} \quad \text{(i)}$$

According to the art of Patent Document 1, during thermal fixing, the entire resin is plasticized by melting the domain A, and the crystalline material constituting the domain A seeps out onto the surface of the toner particle, thereby improving the fixing property and demonstrating a releasability from the fixing member such as a fixing film.

Patent Document 2 discloses a toner having a toner particle containing a binder resin and a colorant, wherein the toner has a storage modulus (G'60) at a temperature of 60° C. of $1.0\times10^{7}$ to $1.0\times10^{9}$ (Pa), a maximum storage modulus (G'p) exists between 110° C. and 140° C., and G'p is $5.0\times10^{4}$ to $5.0\times10^{6}$ (Pa) in viscoelastic characteristics measured at a frequency of 6.28 rad/sec using a rotating plate rheometer.

RELATED ART DOCUMENTS

Patent Documents

Patent Document 1: JP-A-2019-12188
Patent Document 2: JP-A2012-177914

SUMMARY OF THE INVENTION

Problem to be Solved by the Invention

On the other hand, in the art of Patent Document 1 described above, although fixing property such as low-temperature fixing property has been improved, storage stability is not sufficient, and therefore, further improvement has been required.

Further, the art of Patent Document 2 described above is a technique using a polyester-based resin as a binder resin, and in the technique of Patent Document 2 described above, there has been a problem that low-temperature fixing property is not sufficient.

It is an object of the present invention to provide a toner for electrostatic-image development which is excellent in storage stability and low-temperature fixing property.

Means for Solving Problems

The present inventor has investigated that in toner for electrostatic-image development containing color resin particle containing a binder resin, a colorant, a charge control agent, and a release agent, it has been found that the above-mentioned problems can be solved by containing an additive having a polydiene structure in which solubility in styrene at a temperature of 40° C. of 3 to 40 g/100 g as an additive in the color resin particle, and by controlling the presence number of crystal domains of a release agent having an aspect ratio in a range of 2 to 10 in the color resin particle in a specific range, thereby completing the present invention.

Further, the present inventor has further investigated that in toner for electrostatic-image development containing color resin particle containing a binder resin, a colorant, a charge control agent, and a release agent, it has been found that the above-mentioned problems can be solved by containing an additive having a polydiene structure in which solubility in styrene at a temperature of 40° C. of 3 to 40 g/100 g as an additive in the color resin particle, and controlling the storage modulus G'(60) of the color resin particle at 60° C. to be in the range of $1.6\times10^8$ to $5.0\times10^8$ Pa, which is determined by dynamic viscoelasticity measurement.

That is, the present invention provides, as a toner for electrostatic-image development according to a first aspect, a toner for electrostatic-image development comprising a color resin particle containing a binder resin, a colorant, a charge control agent, and a release agent, and an additive having a polydiene structure, wherein the additive having the polydiene structure has a solubility in styrene at a temperature of 40° C. of 3 to 40 g/100 g, and when a cross section of the color resin particle is observed by a transmission electron microscope (TEM), the number of crystal domains of the release agent having an aspect ratio in a range of 2 to 10 in a field of view of 2 μm×2 μm square of the cross section of the color resin particle is 2 to 30.

Alternatively, the present invention provides, as a toner for electrostatic-image development according to a second aspect, a toner for electrostatic-image development comprising a color resin particle containing a binder resin, a colorant, a charge control agent, and a release agent, and an additive having a polydiene structure, wherein the additive having the polydiene structure has a solubility in styrene at a temperature of 40° C. of 3 to 40 g/100 g, and a storage modulus G'(60) of the color resin particle at 60° C., which is determined by dynamic viscoelasticity measurement, is $1.6\times10^8$ to $5.0\times10^8$ Pa.

In the toner for electrostatic-image development according to the second aspect of the present invention, a storage modulus G'(100) of the color resin particle at 100° C., which is determined by dynamic viscoelasticity measurement, is preferably $1.0\times10^5$ to $3.0\times10^5$ Pa.

In the toner for electrostatic-image development according to the second aspect of the present invention, a ratio G'(60)/G'(100) of the storage modulus G'(60) at 60° C. to the storage modulus G'(100) at 100° C., which is determined by dynamic viscoelasticity measurement, is preferably $1.0\times10^3$ to $5.0\times10^3$.

In the toner for electrostatic-image development according to the present invention, the additive having a polydiene structure is preferably a conjugated diene-aromatic vinyl-based thermoplastic elastomer.

In the toner for electrostatic-image development according to the present invention, the conjugated diene-aromatic vinyl-based thermoplastic elastomer is preferably a conjugated diene-aromatic vinyl-based thermoplastic elastomer containing a diblock copolymer composed of an aromatic vinyl polymer block and a block of a polymer copolymerizable with an aromatic vinyl polymer at a ratio of 40% by mass or more.

In the toner for electrostatic-image development according to the present invention, a content ratio of the aromatic vinyl monomer unit in the conjugated diene-aromatic vinyl-based thermoplastic elastomer is preferably 10 to 30% by mass with respect to the total monomer unit.

In the toner for electrostatic-image development according to the present invention, a content of the additive having the polydiene structure is preferably 1 to 10 parts by mass with respect to 100 parts by mass of the binder resin.

In the toner for electrostatic-image development according to the present invention, the release agent is preferably a fatty acid ester compound having a number average molecular weight (Mn) of 500 to 1500.

Effects of Invention

According to the present invention, it is possible to provide a toner for electrostatic-image development which is excellent in storage stability and low-temperature fixing property.

BRIEF DESCRIPTION OF DRAWING(S)

Figure 1B:
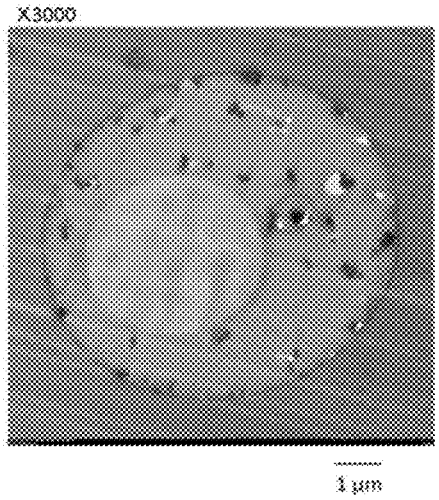

FIG. 1(A) is a cross-sectional photograph of the color resin particle by a transmission electron microscope (TEM) in Example 1-1, and FIG. 1(B) is a cross-sectional photograph of the color resin particle by a transmission electron microscope (TEM) in Comparative Example 1-1.

DESCRIPTION OF EMBODIMENTS

<Toner for Electrostatic-Image Development According to the First Aspect>

A toner for electrostatic-image development according to the first aspect of the present invention (hereinafter, sometimes simply referred to as "toner") is a toner for electrostatic-image development comprising a color resin particle containing a binder resin, a colorant, a charge control agent, and a release agent, and an additive having a polydiene structure, wherein the additive having the polydiene structure has a solubility in styrene at a temperature of 40° C. of 3 to 40 g/100 g, and when a cross section of the color resin particle is observed by a transmission electron microscope (TEM), the number of crystal domains of the release agent having an aspect ratio in a range of 2 to 10 in a field of view of 2 μm×2 μm square of the cross section of the color resin particle is 2 to 30.

First, a production method of color resin particle constituting a toner according to the first aspect of the present invention will be described.

The production method of color resin particle constituting a toner according to the first aspect of the present invention is mainly classified into a dry method such as a pulverization method and a wet method such as an emulsion polymerization aggregation method, a dispersion polymerization method, a suspension polymerization method and a dissolution suspension method, and a wet method is preferred because a toner excellent in printing characteristics such as image reproducibility is easily obtained. Among the wet methods, a polymerization method such as an emulsion polymerization aggregation method, a dispersion polymerization method, and a suspension polymerization method is preferred because it is easy to obtain a toner having a particle size in micrometers and a relatively small particle size distribution, and among these, a suspension polymerization method is more preferred.

The emulsion polymerization aggregation method is a method of producing of color resin particle by polymerizing a polymerizable monomer in an emulsion to prepare a resin fine particle, and aggregating the resin fine particle with a colorant and the like. The dissolution suspension method is a method of producing a color resin particle by dissolving or dispersing toner components such as a binder resin and a colorant in an organic solvent to prepare a solution, dispersing the solution in an aqueous medium to form a droplet, and then removing the organic solvent. In these methods, known techniques can be used.

The color resin particle forming the toner according to the first aspect of the present invention can be produced by any of the wet methods and the dry methods. If (A) a suspension polymerization method as a preferred wet method or (B) a pulverization method as a representative dry method is used to produce the color resin particle, the production is performed by the following process. First, (A) the suspension polymerization method will be described.

(A) Suspension Polymerization Method (A-1) Preparation Step of the Polymerizable Monomer Composition In the suspension polymerization method, first, a polymerizable monomer, a colorant, a charge control agent, a release agent, and an additive having a polydiene structure, and further, if necessary, other additives used are mixed and dissolved to prepare a polymerizable monomer composition. Mixing in preparation of the polymerizable monomer composition is carried out, for example, using a media type disperser.

In the present invention, a polymerizable monomer refers to a polymerizable compound, and the polymerizable monomer is polymerized to become a binder resin. As the polymerizable monomer, a monovinyl monomer is preferably used as a main component constituting the polymerizable monomer. The monovinyl monomers include, for example, styrene-based monomers such as styrene, vinyltoluene, α-methylstyrene, and ethylstyrene; (meth)acrylate-based monomers such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, and dimethylaminoethyl methacrylate; acrylic acid and methacrylic acid; nitrile compounds such as acrylonitrile, and methacrylonitrile; amide compounds such as acrylamide, and methacrylamide; olefins such as ethylene, propylene and butylene; and the like. Each of these monovinyl monomers may be used alone or in combination of two or more thereof. Among these, styrene-based monomers and (meth)acrylate-based monomers are preferred, styrene and butyl acrylate are more preferred. In addition, from the viewpoint that the low-temperature fixing property of the obtained toner can be further improved, it is preferable to use at least styrene-based monomers and (meth)acrylate-based monomer as the monovinyl monomer.

In the binder resin used in the present invention, the content ratio of the styrene-based monomer unit is preferably 60% by mass or more, more preferably 65% by mass or more, still more preferably 68% by mass or more, particularly preferably 70% by mass or more, and the upper limit thereof is preferably 85% by mass or less, more preferably 80% by mass or less, still more preferably 77% by mass or less, particularly preferably 74% by mass or less. Further, the content ratio of the (meth)acrylate-based monomer unit is preferably 20% by mass or more, more preferably 21% by mass or more, still more preferably 21.5% by mass or more, furthermore preferably 22% by mass or more, particularly preferably 24% by mass or more, and the upper limit thereof is preferably 40% by mass or less, more preferably 35% by mass or less, still more preferably 32% by mass or less, furthermore preferably 30% by mass or less, particularly preferably 28% by mass or less, and most preferably 26% by mass or less. By setting the content ratio of the styrene-based monomer unit and the (meth)acrylate-based monomer unit within the above range, it is possible to further enhance the low-temperature fixing property while making the obtained toner excellent in storage stability.

In the present invention, it is preferable to use an optional cross-linkable polymerizable monomer together with a monovinyl monomer for improving hot offset and improving storage property. Cross-linkable polymerizable monomer means a monomer having two or more polymerizable functional groups. Examples of the cross-linkable polymerizable monomer include aromatic divinyl compounds such as divinylbenzene, divinylnaphthalene, and derivatives thereof; ester compounds in which two or more carboxylic acids are esterified to an alcohol having two or more hydroxyl groups such as ethylene glycol dimethacrylate, and diethylene glycol dimethacrylate; other divinyl compounds such as N,N-divinyl aniline, and divinyl ether; compounds having three or more vinyl groups; and the like. Each of these cross-linkable polymerizable monomers may be used alone or in combination of two or more thereof. The amount of the cross-linkable polymerizable monomer to be used is preferably 0.1 to 5 parts by mass, more preferably 0.15 to 2 parts by mass, and still more preferably 0.2 to 0.7 parts by mass, with respect to 100 parts by mass of the monovinyl monomer, and the content ratio of the cross-linkable polymerizable monomer unit in the binder resin used in the present invention is preferably 0.1 to 5% by mass, more preferably 0.15 to 2% by mass, and still more preferably 0.2 to 0.7% by mass. By setting the amount of the cross-linkable polymerizable monomer to be used and the content ratio thereof within the above range, it is possible to further enhance the storage stability and the low-temperature fixing property of the obtained toner.

Further, when a macromonomer is used as a part of the polymerizable monomer, it is possible to further enhance the storage property and the low-temperature fixing property of the obtained toner, and therefore, it is preferable to use an optional macromonomer. Macromonomers are those having a polymerizable carbon-carbon unsaturated bond at the end of the molecular chain, and refer to reactive oligomers or polymers having a number average molecular weight (Mn) that is normally 1,000 to 30,000. Preferably, the macromonomer gives a polymer having a higher Tg (glass transition temperature) than the Tg of the polymer obtained without polymerizing the macromonomer. The amount of the macromonomer to be used is preferably 0.03 to 5 parts by mass, more preferably 0.05 to 1 parts by mass, with respect to 100 parts by mass of the monovinyl monomer.

In the present invention, colorants are used. When color toner (usually, four toners of black, cyan, yellow, and magenta toners are used) are produced, a black colorant, a cyan colorant, a yellow colorant, and a magenta colorant are used for the respective color toners.

Examples of the black colorant to be used include pigments and dyes such as carbon black, titanium black, magnetic powders of zinc iron oxide and nickel iron oxide, and the like.

Examples of the cyan colorant to be used include compounds such as copper phthalocyanine pigments and derivatives thereof, and anthraquinone pigments and dyes. Specifically, examples thereof include C.I. Pigment Blues 2, 3, 6, 15, 15:1, 15:2, 15:3, 15:4, 16, 17:1, 60, and the like.

Examples of the yellow colorant to be used include compounds such as azo pigments such as monoazo pigments and disazo pigments, and fused polycyclic pigments and dyes. Specifically, examples thereof include C.I. Pigment Yellows 3, 12, 13, 14, 15, 17, 62, 65, 73, 74, 83, 93, 97, 120, 138, 151, 155, 180, 181, 185, 186, 214, and 219; and C.I. Solvent Yellows 98, and 162; and the like.

Examples of the magenta colorant to be used include compounds such as azo pigments such as monoazo pigments and disazo pigments; fused polycyclic pigments and dyes; and the like. Specifically, examples thereof include C.I. Pigment Reds 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, and 251; C.I. Solvent Violets 31, 47, and 59; C.I. Pigment Violet 19; and the like.

In the present invention, each colorant may be used alone or in combination of two or more, and the amount of the colorant to be used is preferably 1 to 10 parts by mass with respect to 100 parts by mass of the binder resin (100 parts by mass of the polymerizable monomer for obtaining the binder resin).

As the charge control agent, there is no particular limitation as long as it is generally used as a charge control agent for a toner, but among the charge control agents, from the viewpoint that a compatibility with a polymerizable monomer is high, a stable charging property (charging stability) can be imparted to the toner particle, and thereby, the dispersibility of the colorant can be improved, a charge control resin having a positive charging property or a negative charging property is preferred. And further, from the viewpoint that a negative charging property toner is obtained, a charge control resin having a negative charging property is more preferably used.

Examples of the positively chargeable charge control agent include a nigrosine dye, a quaternary ammonium salt, a triaminotriphenylmethane compound and an imidazole compound, and a polyamine resin, quaternary ammonium group-containing copolymer and quaternary ammonium salt group-containing copolymer as charge control resins which are preferably used.

Examples of the negatively chargeable charge control agent include an azo dye containing a metal such as Cr, Co, Al, and Fe, a salicylic acid metal compound and an alkylsalicylic acid metal compound, and a sulfonic acid group-containing copolymer, a sulfonate group-containing copolymer, a carboxylic acid group-containing copolymer, and a carboxylate group-containing copolymer as charge control resins which are preferably used.

The weight average molecular weight (Mw) of the charge control resin is within a range of 5,000 to 30,000, preferably within a range of 8,000 to 25,000, and more preferably within a range of 10,000 to 20,000, in terms of polystyrene measured by gel permeation chromatography (GPC) using tetrahydrofuran.

In addition, the copolymerization ratio of the monomer having a functional group such as a quaternary ammonium group and a sulfonate group in the charge control resin is preferably within a range of 0.5 to 12% by mass, more preferably within a range of 1.0 to 6% by mass, and still more preferably within a range of 1.5 to 3% by mass.

The content of the charge control agent is preferably 0.01 to 10 parts by mass, more preferably 0.03 to 8 parts by mass, with respect to 100 parts by mass of the binder resin (100 parts by mass of the polymerizable monomer for obtaining the binder resin). By setting the amount of the charge control agent to be added within the above range, it while effectively suppressing the occurrence of fogging and the occurrence of print dirt.

As the release agent, a release agent generally used as a release agent for a toner can be used without any particular limitation, but from the viewpoint of appropriately enhancing the low-temperature fixing property of the obtained toner, a release agent having a number average molecular weight (Mn) of 500 to 1500 is preferable, and a fatty acid ester compound having a number average molecular weight (Mn) of 500 to 1500 is preferable. Note that the "fatty acid ester compound" refers to a product obtained by an ester reaction of a monovalent alcohol and/or a polyvalent alcohol and a saturated fatty acid and/or an unsaturated fatty acid.

Examples of monovalent alcohols include monovalent saturated aliphatic alcohols such as methanol, ethanol, 1-propanol, 2-propanol, 1-butanol, 2-butanol, 1-pentanol, 1-hexanol, octanol, 2-ethyl-1-hexanol, nonyl alcohol, lauryl alcohol, cetyl alcohol, stearyl alcohol, and behenyl alcohol; monovalent unsaturated aliphatic alcohols such as allyl alcohol, methallyl alcohol, crotyl alcohol, and oleyl alcohol; monovalent alicyclic alcohols such as cyclohexanol; monovalent aromatic alcohols such as phenol, phenyl methanol (benzyl alcohol) methyl phenol (cresol), p-ethyl phenol, dimethyl phenol (xylenol), nonyl phenol, dodecyl phenol, phenyl phenol, and naphthol.

Specific examples of the polyvalent alcohol include divalent saturated aliphatic alcohols such as ethylene glycol, and propylene glycol; divalent aromatic alcohols such as catechol, and hydroquinone; three- or more-valent saturated aliphatic alcohols such as glycerin, pentaerythritol, dipentaerythritol, and polyglycerin; and the like.

Among these monovalent alcohols and polyvalent alcohols, monovalent to tetravalent saturated aliphatic alcohols are preferred, stearyl alcohol, behenyl alcohol and pentaerythritol are more preferred, stearyl alcohol and behenyl alcohol are more preferred, and behenyl alcohol is particularly preferred.

The fatty acid serving as a raw material of the fatty acid ester compound is preferably a saturated fatty acid and/or an unsaturated fatty acid having 12 to 22 carbon atoms, more preferably these having 14 to 18 carbon atoms. Of these, a saturated fatty acid having the above number of carbon atoms is particularly preferred because a fatty acid ester compound having a number average molecular weight (Mn) of 500 to 1500 is easily obtained.

Specific examples of the saturated fatty acid having the above carbon number include, but are not limited to, lauric acid (carbon number of 12), myristic acid (carbon number of 14), pentadecyl acid (carbon number of 15), palmitic acid (carbon number of 16), margaric acid (carbon number of 17), stearic acid (carbon number of 18), arachidic acid (carbon number of 20), and behenic acid (carbon number of 22). Among these saturated fatty acids, stearic acid (carbon number of 18), arachidic acid (carbon number of 20), and behenic acid (carbon number of 22) are preferred, and stearic acid (carbon number of 18) is more preferred.

Specific examples of the unsaturated fatty acid are not particularly limited, and examples thereof include the following compounds.

palmitoleic acid ($CH_3(CH_2)_5CH{=}CH(CH_2)_7COOH$)
oleic acid ($CH_3(CH_2)_7CH{=}CH(CH_2)_7COOH$)
vaccenic acid ($CH_3(CH_2)_5CH{=}CH(CH_2)_9COOH$)
linoleic acid ($CH_3(CH_2)_3(CH_2CH{=}CH)_2(CH_2)_7COOH$)
(9,12,15)-linolenic ($CH_3(CH_2CH{=}CH)_3(CH_2)_7COOH$)
(6,9,12)-linolenic ($CH_3(CH_2)_3(CH_2CH{=}CH)_3(CH_2)_4COOH$)
eleostearic acid ($CH_3(CH_2)_3(CH{=}CH)_3(CH_2)_7COOH$)
arachidonic acid ($CH_3(CH_2)_3(CH_2CH{=}CH)_4(CH_2)_3COOH$)

Note that, only one kind of the above-mentioned saturated fatty acids and/or unsaturated fatty acids may be used alone, or two or more kinds thereof may be used in combination. Of the saturated fatty acids and unsaturated fatty acids, saturated fatty acids are preferred, stearic acid, arachidic acid and behenic acid are more preferred, stearic acid and behenic acid are further preferred, and behenic acid is particularly preferred.

The fatty acid ester compound as described above can be produced according to a conventional method. Examples of the method for producing such a fatty acid ester compound include a method of performing an ester reaction using a monovalent alcohol and/or a polyvalent alcohol and a saturated fatty acid and/or an unsaturated fatty acid. Further, it is also possible to use a commercially available fatty acid ester compound as the fatty acid ester compound, and examples of the commercially available fatty acid ester compound include "WEP2", "WEP3", "WEP4", "WEP5", "WE6", and "WE11" (trade name) manufactured by NOF Corporation, and the like.

In addition, in the present invention, a release agent other than the fatty acid ester compound may be used as the release agent in place of or together with the fatty acid ester compound described above, and examples thereof include a low molecular weight polyolefin wax, and a modified wax thereof; a plant-based natural wax such as jojoba; a petroleum wax such as paraffin; a mineral-based wax such as ozokerite; a synthetic wax such as Fischer-Tropsch wax; an ester of a polyvalent alcohol ester such as dipentaerythritol ester; and the like. These may be used only in one kind, and two or more kinds thereof may be used in combination.

The number average molecular weight (Mn) of the release agent is preferably 500 to 1500, more preferably 550 to 1200, and still more preferably 550 to 1100. Note that, the number average molecular weight (Mn) of the release agent can be measured, for example, in teems of polystyrene measured by gel permeation chromatography (GPC) using tetrahydrofuran.

The content of the release agent is preferably 1 to 30 parts by mass, more preferably 8 to 28 parts by mass, and still more preferably 12 to 25 parts by mass, with respect to 100 parts by mass of the binder resin (100 parts by mass of the polymerizable monomer for obtaining the binder resin). By setting the content of the release agent in the above range, the low-temperature fixing property can be further enhanced while making the particle size distribution of the obtained toner relatively uniform.

In addition, in the present invention, the color resin particle further includes an additive having a polydiene structure with a solubility in styrene at a temperature of 40° C. of 3 to 40 g/100 g. In the present invention, by using such an additive having a polydiene structure, it is possible to finely disperse the release agent in the color resin particle in a state such that the release agent has a specific crystal domain structure by compatibility with the release agent provided by the additive having the polydiene structure. Further, in the present invention, by finely dispersing the release agent in a state having a specific crystal domain structure, the effect of improving the low-temperature fixing property by adding the release agent can be made sufficient while effectively suppressing blocking of the obtained toner, and as a result, the obtained toner can be made excellent in the storage stability and the low-temperature fixing property.

The additive having the polydiene structure used in the present invention may be any compound having a polydiene structure (that is, a structure derived from a diene compound) and having a solubility in styrene at a temperature of 40° C. of 3 to 40 g/100 g, and is not particularly limited. The solubility of the additive having the polydiene structure in styrene at a temperature of 40° C. is preferably from 5 to 30 g/100 g, more preferably from 10 to 25 g/100 g. If the solubility in styrene at a temperature of 40° C. is too low, the dispersibility in the color resin particle is lowered, thereby lowering the compatibility with the release agent, resulting in insufficient dispersion of the release agent. As a result, the low-temperature fixing property and the storage stability of the obtained toner deteriorate. On the other hand, if the solubility in styrene is too high, the release agent is compatible with the binder resin in the color resin particle, so that the crystal domain cannot be formed, and the low-temperature fixing property and storage stability of the toner deteriorate.

The additive having the polydiene structure used in the present invention is not particularly limited, and examples thereof include a conjugated diene-aromatic vinyl-based thermoplastic elastomer which is a polymer having a structural unit derived from a conjugated diene compound and a structural unit derived from an aromatic vinyl compound; a conjugated diene-based elastomer such as polybutadiene rubber and polyisoprene rubber; and the like, but a conjugated diene-aromatic vinyl-based thermoplastic elastomer is suitable, and, among the conjugated diene-aromatic vinyl-based thermoplastic elastomers, an unhydrogenated conjugated diene-aromatic vinyl-based thermoplastic elastomer is particularly suitable.

The conjugated diene-aromatic vinyl-based thermoplastic elastomer, as the additive having the polydiene structure used in the present invention, has an unsaturated bond capable of polymerization reaction in its structure, and by having such an unsaturated bond capable of polymerization reaction, the unsaturated bond capable of polymerization reaction reacts with the binder resin, whereby the conjugated diene-aromatic vinyl-based thermoplastic elastomer interacts with the release agent in a state of being fixed to the binder resin. Thus, in the binder resin constituting the color resin particle, the release agent can be finely dispersed sufficiently, as a result, the effect of improving the low-temperature fixing property by adding the release agent can be made sufficient while effectively suppressing the blocking of the obtained toner, and as a result, the obtained toner can be made excellent in the storage stability and the low-temperature fixing property. Note that, in the present invention, "unsaturated bond capable of polymerization reaction" means an unsaturated bond having a polymerization activity, and an olefinic carbon-carbon double bond having a polymerization activity is suitably mentioned.

Examples of the conjugated diene-aromatic vinyl-based thermoplastic elastomer used in the present invention include copolymers such as random copolymer, block copolymer, and graft copolymer of a conjugated diene monomer, an aromatic vinyl monomer, and other monomers which can be copolymerized with these, if necessary, and hydrogenates of such copolymers.

Such a conjugated diene-aromatic vinyl-based thermoplastic elastomer is not particularly limited, but a block copolymer containing at least one aromatic vinyl polymer block and at least one conjugated diene polymer block can be suitably used from the viewpoint of further enhancing storage stability and low-temperature fixing property of the toner.

Hereinafter, a block copolymer containing at least one aromatic vinyl polymer block and at least one conjugated diene polymer block (hereinafter, sometimes simply referred to as a "block copolymer") which is a representative example of the conjugated diene-aromatic vinyl-based thermoplastic elastomer will be described. The block copolymer used in the present invention is one comprising at least one aromatic vinyl polymer block obtained by polymerizing an aromatic vinyl monomer and at least one conjugated diene polymer block obtained by polymerizing a conjugated diene monomer, respectively.

The aromatic vinyl monomer is not particularly limited as long as it is an aromatic vinyl compound, but styrene, α-methylstyrene, 2-methylstyrene, 3-methylstyrene, 4-methylstyrene, 2-ethylstyrene, 3-ethylstyrene, 4-ethylstyrene, 2,4-diisopropylstyrene, 2,4-dimethylstyrene, 4-t-butylstyrene, 5-t-butyl-2-methylstyrene, 2-chlorostyrene, 3-chlorostyrene, 4-chlorostyrene, 4-bromostyrene, 2-methyl-4,6-dichlorostyrene, 2,4-dibromostyrene, vinylnaphthalene, and the like. Of these, styrene is preferably used. These aromatic vinyl monomers may be used alone or in combination of two or more of them in each of the aromatic vinyl polymer blocks. In addition, when the block copolymer has a plurality of aromatic vinyl polymer blocks, each aromatic vinyl polymer block may be composed of the same aromatic vinyl monomer unit or may be composed of different aromatic vinyl monomer units.

The aromatic vinyl polymer block may contain another monomer unit as long as the aromatic vinyl monomer unit becomes a main repeating unit. The examples of the other monomers usable in the aromatic vinyl polymer block include conjugated diene monomers such as 1,3-butadiene, isoprene (2-methyl-1,3-butadiene), α,β-unsaturated nitrile monomers, unsaturated carboxylic acids or acid anhydride monomers, unsaturated carboxylic acid ester monomers, non-conjugated diene monomers, and the like. The content of the monomer unit other than the aromatic vinyl monomer unit in the aromatic vinyl polymer block is preferably 20% by mass or less, more preferably 10% by mass or less, and particularly preferably substantially 0% by mass.

The conjugated diene monomer is not particularly limited as long as it is a conjugated diene compound, and examples thereof include 1,3-butadiene, isoprene, 2,3-dimethyl-1,3-butadiene, 2-chloro-1,3-butadiene, 1,3-pentadiene, and 1,3-hexadiene. Of these, from the viewpoint of high effect of improving storage stability and low-temperature fixing property, 1,3-butadiene and/or isoprene is preferably used, and isoprene is particularly preferably used. These conjugated diene monomers may be used alone or in combination of two or more of them in each conjugated diene polymer block. In addition, when the block copolymer has a plurality of conjugated diene polymer blocks, each conjugated diene polymer block may be composed of the same conjugated diene monomer unit or may be composed of different conjugated diene monomer units. Further, a hydrogenation reaction may be performed on a portion of the unsaturated bond of each conjugated diene polymer block.

The conjugated diene polymer block may contain another monomer unit as long as the conjugated diene monomer unit becomes a main repeating unit. The examples of the other monomers usable in the diene polymer block include aromatic vinyl monomers such as styrene, and α-methylstyrene, α,β-unsaturated nitril monomers, unsaturated carboxylic acids or acid anhydride monomers, unsaturated carboxylic acid ester monomers, non-conjugated diene monomers, and the like. The content of the monomer unit other than the conjugated diene monomer unit in the conjugated diene polymer block is preferably 20% by mass or less, more preferably 10% by mass or less, and particularly preferably substantially 0% by mass.

The vinyl bond content of the conjugated diene polymer block (in the total conjugated diene monomer unit in the conjugated diene polymer block, the ratio occupied by the 1,2-vinyl bond unit and the 3,4-vinyl bond unit) is not particularly limited, but is preferably 1 to 20 mol %, more preferably 2 to 15 mol %, and particularly preferably 3 to 10 mol %.

As long as the block copolymer contains at least one aromatic vinyl polymer block and at least one conjugated diene polymer block, the number of the respective polymer blocks and the bonding form thereof are not particularly limited. Specific examples of the block copolymer used in the present invention include the following. In the following specific examples, Ar represents an aromatic vinyl polymer block, D represents a conjugated diene polymer block, X represents a residue of a coupling agent, and "n" represents an integer of 2 or more.

(a) Aromatic vinyl-conjugated diene block copolymer represented as Ar-D
(b) Aromatic vinyl-conjugated diene-aromatic vinyl block copolymer represented as Ar-D-Ar and/or (Ar-D)n-X
(c) Conjugated diene-aromatic vinyl-conjugated diene block copolymer represented as D-Ar-D and/or (D-Ar)n-X
(d) Aromatic vinyl-conjugated diene-aromatic vinyl-conjugated diene block copolymer represented as Ar-D-Ar-D
(e) A composition of block copolymers comprising two or more of (a) to (d) above arbitrarily In the present invention, it is preferable to use, as the block copolymer, those containing at least the aromatic vinyl-conjugated diene block copolymer represented as the above (a) Ar-D, and more preferably those containing at least the aromatic vinyl-conjugated diene block copolymer represented as the above (a) Ar-D and the aromatic vinyl-conjugated diene-aromatic vinyl block copolymer represented as (b) Ar-D-Ar and/or (Ar-D)n-X. In the conjugated diene-aromatic vinyl-based thermoplastic elastomer used in the present invention, the content of the aromatic vinyl-conjugated diene block copolymer represented by Ar-D (that is, a diblock copolymer composed of an aromatic vinyl polymer block and a block of a polymer copolymerizable with an aromatic vinyl polymer) is preferably 40% by mass (% by weight) or more, preferably 50% by mass or more, and more preferably 55% by mass or more. Further, the upper limit thereof is not particularly limited, but is preferably 98% by mass or less, and more preferably 95% by mass or less. By setting the content of the aromatic vinyl-conjugated diene block copolymer represented by Ar-D (that is, a diblock copolymer composed of an aromatic vinyl polymer block and a block of a polymer copolymerizable with an aromatic vinyl polymer) in the conjugated diene-aromatic vinyl-based thermoplastic elastomer used in the present invention to 40% by mass or more, it is possible to make the obtained toner highly chargeable and to suppress bleed-out of the release agent, and to effectively suppress occurrence of jetting under high-temperature and high-humidity conditions and sticking to the blade.

In the aromatic vinyl-conjugated diene block copolymer represented by Ar-D, the weight average molecular weight of the aromatic vinyl polymer block Ar (Mw(Ar)) is not particularly limited, but is preferably 10000 to 50000, more preferably 15000 to 30000, and the weight average molecular weight of the conjugated diene polymer block D (Mw(D)) is not particularly limited, but is preferably 50000 to 200000, more preferably 60000 to 150000.

In addition, in the aromatic vinyl-conjugated diene-aromatic vinyl block copolymer represented by Ar-D-Ar and/or (Ar-D)n-X, the weight average molecular weight of the aromatic vinyl polymer block Ar (Mw(Ar)) is not particularly limited, but is preferably 20000 to 70000, more preferably 25000 to 50000, and the weight average molecular weight of the conjugated diene polymer block D (Mw(D)) is not particularly limited, but is preferably 100000 to 300000, more preferably 120000 to 250000.

Note that, all of the above weight average molecular weights are values in terms of polystyrene measured by gel permeation chromatography (GPC) using tetrahydrofuran.

In the block copolymer used in the present invention, the content ratio of the aromatic vinyl monomer unit to the total monomer units is preferably 10 to 30% by mass, more preferably 12 to 25% by mass, and still more preferably 15 to 25% by mass. By setting the content ratio of the aromatic vinyl monomer unit within the above range, it is possible to highly balance the affinity of the block copolymer for the release agent and the affinity of the block copolymer for the binder resin, and it is possible to make the obtained toner more excellent in storage stability and low-temperature fixing property.

If the block copolymer is substantially composed of only an aromatic vinyl monomer unit and a conjugated diene monomer unit, the content of the aromatic vinyl monomer unit in the block copolymer can be measured according to the method described in Rubber Chem. Technol., 45, 1295 (1972), by ozonolyzing the block copolymer then reducing the ozonolyzed product using lithium aluminum hydride, the conjugated diene monomer unit portion is decomposed and the aromatic vinyl monomer unit portion can be taken out, so that the aromatic vinyl monomer unit content can be measured by such a method.

Further, the weight average molecular weight (Mw) of the aromatic vinyl monomer unit in the block copolymer is not particularly limited, but is preferably 10000 to 50000, more preferably 20000 to 40000, in terms of polystyrene measured by gel permeation chromatography (GPC) using tetrahydrofuran. In addition, the weight average molecular weight (Mw) of the conjugated diene monomer unit in the block copolymer is not particularly limited, but is preferably 50000 to 200000, and more preferably 60000 to 180000.

The melt index (MI) of the block copolymer is not particularly limited, but is selected as a value measured according to ASTM D-1238 (G condition, 200° C., 5 kg), for example, in a range of 1 to 1000 g/10 min, and is preferably 5 to 30 g/10 min.

The block copolymer used in the present invention can be produced according to a conventional method. Examples of such a method for producing a block copolymer include a method in which an aromatic vinyl monomer and a conjugated diene monomer are each sequentially polymerized by an anion living polymerization method to form a polymer block, and if necessary, a coupling agent is reacted to perform coupling.

In addition, when a block copolymer containing at least the aromatic vinyl-conjugated diene block copolymer represented by the above (a) Ar-D and the aromatic vinyl-conjugated diene-aromatic vinyl block copolymer represented by (b) Ar-D-Ar and/or (Ar-D)n-X is used as the block copolymer used in the present invention, the following method can be employed.

In other words, first, an aromatic vinyl monomer is polymerized by an anion living polymerization method, followed by adding a conjugated diene monomer and performing polymerization to obtain a diblock copolymer having an active terminal. Then, by adding a coupling agent of less than 1 molar equivalents to the active terminal of the diblock copolymer having the active terminal, a coupling reaction is performed for a part of the diblock copolymer having the active terminal to obtain the aromatic vinyl-conjugated diene-aromatic vinyl block copolymer represented as (Ar-D)n-X, and then a polymerization terminator is added, whereby the remaining diblock copolymer having the remaining active terminal is deactivated to obtain the diblock copolymer represented by Ar-D. Incidentally, at this time, by using a two functional coupling agent such as dichlorosilane, monomethyldichlorosilane, dimethyldichlorosilane, diphenyldimethoxysilane, diphenyldiethoxysilane, dichloroethane, dibromoethane, methylene chloride, and dibromomethane as the coupling agent, the aromatic vinyl-conjugated diene-aromatic vinyl block copolymer represented by Ar-D-Ar (in D, a residue of a coupling agent is contained) can be obtained.

In the present invention, the content ratio of (a) aromatic vinyl-conjugated diene block copolymer represented by Ar-D and (b) aromatic vinyl-conjugated diene-aromatic vinyl block copolymer represented by Ar-D-Ar and/or (Ar-D)n-X is not particularly limited, but the content ratio of (a) aromatic vinyl-conjugated diene block copolymer represented by Ar-D is preferably 10 to 90% by mass, more preferably 20 to 80% by mass. Further, the content ratio of (b) aromatic vinyl-conjugated diene-aromatic vinyl block copolymer represented by Ar-D-Ar and/or (Ar-D)n-X is preferably 10 to 90% by mass, more preferably 20 to 80% by mass.

Further, as the conjugated diene-aromatic vinyl-based thermoplastic elastomer, a random copolymer of an aromatic vinyl monomer and a conjugated diene monomer can be used instead of the block copolymer described above. The random copolymer of the aromatic vinyl monomer and the conjugated diene monomer can be produced, for example, by an anion living polymerization using an organoalkalimetal compound as a polymerization initiator. Examples of the organoalkalimetal compound include an organolithium compound, an organosodium compound, and an organopotassium compound. The specifically examples thereof include organomonolithium compounds such as n-butyllithium, sec-butyllithium, t-butyllithium, hexyllithium, phenyllithium, and stilbenelithium; organopolyvalentlithium compounds such as dilithiomethane, 1,4-dilithiobutane, 1,4-dilithio-2-ethylcyclohexane, and 1,3,5-trilithiobenzene, 1,3,5-tris(lithiomethyl)benzene; organosodium compounds such as sodium naphthalene; organopotassium compounds such as potassium naphthalene; and the like. Among these organometallic compounds, n-butyllithium is preferably used.

In the random copolymer of the aromatic vinyl monomer and the conjugated diene monomer used in the present invention, the content ratio of the aromatic vinyl monomer unit to the total monomer units is preferably 50% by mass or less, more preferably 45% by mass or less, and still more preferably 40% by mass or less. By setting the content ratio of the aromatic vinyl monomer unit within the above range, it is possible to highly balance the affinity of the random copolymer for the release agent and the affinity of the random copolymer for the binder resin, and it is possible to make the obtained toner more excellent in storage stability and low-temperature fixing property.

Further, in the present invention, a conjugated diene-based elastomer such as polybutadiene rubber and polyisoprene rubber can be suitably used as the additive having the polydiene structure. The conjugated diene-based elastomers such as polybutadiene rubber and polyisoprene rubber can be produced, for example, by an anion living polymerization using an organoalkalimetal compound as a polymerization initiator. As the organoalkalimetal compound, for example, those described above can be used.

The weight average molecular weight (Mw) of the additive having the polydiene structure used in the present invention, is not particularly limited, but is preferably 60,000 to 350,000, more preferably 80,000 to 250,000, in terms of polystyrene measured by gel permeation chromatography (GPC) using tetrahydrofuran. By setting the weight average molecular weight (Mw) within the above range, it is possible to further enhance the storage stability and the low-temperature fixing property of the obtained toner.

The content of the additive having the polydiene structure is preferably 1 to 10 parts by mass, more preferably 1.5 to 8 parts by mass, and still more preferably 2 to 5 parts by mass, with respect to 100 parts by mass of the binder resin (100 parts by mass of the polymerizable monomer for obtaining the binder resin). By setting the content of the additive having the polydiene structure within the above range, it is possible to further enhance the effect of adding, that is, it is possible to further enhance the effect of improving the storage stability and the low-temperature fixing property of the obtained toner.

In addition, in the present invention, as another additive, an acrylic resin can be used to further suppress bleed-out of the release agent.

The acrylic resin is a copolymer (acrylate-based copolymer) containing at least one of an acrylic ester and a methacrylic ester and at least one of an acrylic acid and a methacrylic acid as a main component. As an acid monomer, acrylic acid is preferred.

Examples of the acrylic resin include a copolymer of the acrylic ester and the acrylic acid, a copolymer of the acrylic ester and the methacrylic acid, a copolymer of the methacrylic ester and the acrylic acid, a copolymer of the methacrylic ester and the methacrylic acid, a copolymer of the acrylic ester and the methacrylic ester, a copolymer of the acrylic ester, the methacrylic ester and the methacrylic acid, and a copolymer of the acrylic ester, the methacrylic ester, the acrylic acid and the methacrylic acid. Of these, the copolymer of the acrylic ester, the methacrylic ester and the acrylic acid is preferably used.

The acid value of the acrylic resin is usually 0.5 to 7 mgKOH/g, preferably 1 to 6 mgKOH/g, and more preferably 1.5 to 4 mgKOH/g. By setting the acid value of the acrylic resin in the above range, it is possible to be good in heat-resistant storage, low-temperature fixing property and printing durability under the temperature and humidity environment from the low temperature and low humidity environment to the high temperature and high humidity environment, while making it possible to produce desired color resin particle satisfactorily.

Note that, the acid value of the acrylic resin is a value measured according to JIS K 0070, which is a criterion oil and fat analysis method established by the Japan Industrial Standards Committee (JISC).

The weight average molecular weight (Mw) of the acrylic resin is usually 6,000 to 50,000, preferably 8,000 to 25,000, and more preferably 10,000 to 20,000.

When the weight average molecular weight (Mw) of the acrylic resin is within the above range, heat-resistant storage, durability, and low-temperature fixing property can be improved.

The glass transition temperature Tg of the acrylic resin is usually 60 to 85° C., preferably 65 to 80° C., and more preferably 70 to 77° C. When the glass transition temperature is within the above range, the heat-resistant storage and the low-temperature fixing property can be improved.

The glass transition temperature Tg of the acrylic resin can be determined, for example, according to ASTM D3418-82.

In the acrylic resin, the ratio of an acrylic ester monomer unit, a methacrylic ester monomer unit, an acrylic acid monomer unit, and a methacrylic acid monomer unit is not particularly limited as long as it satisfies the above-described acid value, weight average molecular weight Mw, and glass transition temperature.

The ratio of the four types of monomer units described above can be adjusted by the mass ratio of the amount of the acrylic ester, the methacrylic ester, the acrylic acid, and the methacrylic acid added during the synthesis of the copolymer. The mass ratio of the amount to be added is, for example, (acrylic ester and/or methacrylic ester):(acrylic acid and/or methacrylic acid)=(99 to 99.95):(0.05 to 1). It is preferable that (acrylic ester and/or methacrylic ester):(acrylic acid and/or methacrylic acid)=(99.4 to 99.9):(0.1 to 0.6), and more preferably (acrylic ester and/or methacrylic ester):(acrylic acid and/or methacrylic acid)=(99.5 to 99.7):(0.3 to 0.5). Incidentally, among these polymerizable monomers, the acrylic ester and/or the methacrylic ester may be substituted with other monomers such as a styrene derivative, a nitrile compound, and an amide compound exemplified as the monovinyl monomer constituting the binder resin within a range not impairing the effect of the present invention. The ratio thereof is 10% by mass or less, preferably 2% by mass or less, with respect to the total amount of the acrylic ester and/or methacrylic ester added, and is preferably not substituted.

Examples of the acrylic ester used in the acrylic resin include methyl acrylate, ethyl acrylate, n-propyl acrylate, isopropyl acrylate, n-butyl acrylate, isobutyl acrylate, sec-butyl acrylate, tert-butyl acrylate, n-pentyl acrylate, isopentyl acrylate, neopentyl acrylate, n-hexyl acrylate, isohexyl acrylate, neohexyl acrylate, sec-hexyl acrylate, and tert-hexyl acrylate. Among these, ethyl acrylate, n-propyl acrylate, isopropyl acrylate, and n-butyl acrylate are preferred, and n-butyl acrylate is more preferred.

Examples of the acrylic ester used in the acrylic resin include methyl methacrylate, ethyl methacrylate, n-propyl methacrylate, isopropyl methacrylate, n-butyl methacrylate, isobutyl methacrylate, sec-butyl methacrylate, tert-butyl methacrylate, n-pentyl methacrylate, isopentyl methacrylate, neopentyl methacrylate, n-hexyl methacrylate, isohexyl methacrylate, neohexyl methacrylate, sec-hexyl methacrylate, and tert-hexyl methacrylate. Among these, methyl methacrylate, n-propyl methacrylate, isopropyl methacrylate, and n-butyl methacrylate are preferred, and methyl methacrylate is more preferred.

The amount of the above acrylic resin to be added is preferably 0.3 to 4 parts by mass, more preferably 0.5 to 3.0 parts by mass, and still more preferably 0.7 to 2.0 parts by mass, with respect to 100 parts by mass of the binder resin (100 parts by mass of the polymerizable monomer for obtaining the binder resin). By setting the amount of the acrylic resin to be added in the above range, it is possible to make the effect for adding sufficient while making the environmental stability good.

The acrylic resin may be commercially available, but may be produced by a known method such as a solution polymerization method, an aqueous solution polymerization method, an ionic polymerization method, a high-temperature and high-pressure polymerization method, and a suspension polymerization method.

Further, as other additives, a molecular weight adjusting agent may be used. The molecular weight adjusting agent is not particularly limited as long as it is generally used as a molecular weight adjusting agent for toner, and for example, mercaptans such as t-dodecylmercaptan, n-dodecylmercaptan, n-octylmercaptan, 2,2,4,6,6-pentamethylheptane-4-thiol; thiuram disulfides such as tetramethylthiuram disulfide, tetraethylthiuram disulfide, tetrabutylthiuram disulfide, N,N'-dimethyl-N,N'-diphenylthiuram disulfide, N,N'-dioctadecyl-N,N'-diisopropylthiuram disulfide; and the like may be mentioned. Each of these molecular weight adjusting agents may be used alone or in combination of two or more thereof. The amount of the molecular weight adjusting agent to be used is preferably 0.01 to 10 parts by mass, more preferably 0.1 to 5 parts by mass, with respect to 100 parts by mass of the binder resin (100 parts by mass of the polymerizable monomer for obtaining the binder resin).

(A-2) Suspending Step (Droplet Forming Step) to Obtain a Suspension

Then, a polymerizable monomer composition containing the polymerizable monomer, the colorant, the charge control agent, the release agent, and the additive having the polydiene structure obtained by the above (A-1) preparation step of polymerizable monomer composition is dispersed in an aqueous dispersion medium, and a polymerization initiator is added, followed by droplet formation of the polymerizable monomer composition. Here, suspension means forming droplets of a polymerizable monomer composition in an aqueous dispersion medium. Dispersion treatment for forming droplets can be performed using, for example, a device capable of strong agitation such as an in-line emulsification disperser (manufactured by Pacific Machinery & Engineering Co., Ltd., trade name: Milder), a high-speed emulsifier/disperser (manufactured by Primix Corporation, trade name: T. K. Homomixer MARK II), and the like.

As the polymerization initiator, persulfates such as potassium persulfate, and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile), and 2,2'-azobisisobutyronitrile; organic peroxides such as di-t-butylperoxide, benzoyl peroxide, t-butyl peroxy-2-ethylhexanoate, t-hexyl peroxy-2-ethylbutanoate, diisopropyl peroxydicarbonate, di-t-butyl peroxyisophthalate, and t-butyl peroxyisobutyrate; and the like may be mentioned. These may be used alone or in combination of two or more thereof. Among these, it is preferable to use the organic peroxides because the residual polymerizable monomer can be reduced and the printing durability is also excellent. In addition, among the organic peroxides, peroxy esters are preferred, and non-aromatic peroxy esters, i.e., peroxy esters having no aromatic ring are more preferred because the efficiency as the initiator is high and the residual polymerizable monomer can be reduced.

The polymerization initiator may be added before droplet formation after the polymerizable monomer composition is dispersed in an aqueous medium as described above, but may be added to the polymerizable monomer composition before being dispersed in an aqueous medium (a medium containing water as a main component).

The amount of the polymerization initiator to be added, which is used for polymerization of the polymerizable monomer composition, is preferably 0.1 to 20 parts by mass, more preferably 0.3 to 15 parts by mass, and particularly preferably 1 to 10 parts by mass, with respect to 100 parts by mass of the binder resin (100 parts by mass of the polymerizable monomer for obtaining the binder resin).

In the present invention, it is preferable that a dispersion stabilizer is contained in an aqueous medium. Examples of the dispersion stabilizer include, as inorganic compounds, sulfates such as barium sulfate, and calcium sulfate; carbonates such as barium carbonate, calcium carbonate, and magnesium carbonate; phosphates such as calcium phosphate; metal oxides such as aluminum oxide and titanium oxide; metal hydroxides such as aluminum hydroxide, magnesium hydroxide, and ferric hydroxide; as organic compounds, water-soluble polymers such as polyvinyl alcohol, methylcellulose, and gelatin; anionic surfactants; nonionic surfactants; amphoteric surfactants. As the above dispersion stabilizers, one kind or two or more kinds may be used in combination. The amount of the dispersion stabilizer to be added is preferably 0.1 to 20 parts by mass, more preferably 0.2 to 10 parts by mass, with respect to 100 parts by mass of the binder resin (100 parts by mass of the polymerizable monomer for obtaining the binder resin).

Among the above dispersion stabilizer, the inorganic compound is preferred, and particularly, a colloid of poorly water-soluble metal hydroxide is preferred. By using an inorganic compound, in particular, the colloid of poorly water-soluble metal hydroxide, the particle size distribution of the color resin particle can be narrowed, and the residual amount of the dispersion stabilizer after washing can be reduced, so that the reproduction of the image by the obtained toner can be made clearer without deteriorating the environmental stability.

(A-3) Polymerization Step

By heating a desired suspension (an aqueous dispersion medium containing droplets of the polymerizable monomer composition) obtained by the above (A-2) suspending step (droplet forming step) to obtain a suspension and initiating polymerization, an aqueous dispersion of the color resin particle containing the binder resin, the colorant, the charge control agent, the release agent, and the additive having the polydiene structure is obtained.

The polymerization temperature in the present invention is preferably 50° C. or higher, more preferably 60 to 95° C. In addition, the polymerization time in the present invention is preferably 1 to 20 hours, more preferably 2 to 15 hours.

Note that, from the viewpoint of performing polymerization in a state in which droplets of the polymerizable monomer composition are stably dispersed, in the polymerization step, the polymerization reaction may proceed while performing the dispersion treatment by stirring following (A-2) suspending step (droplet forming step) to obtain a suspension.

In the present invention, an external additive may be added to the color resin particle thus prepared as it is, and the product may be used as a toner. Alternatively, so-called core-shell type (or also referred as "capsule type") color resin particle may be prepared, the color resin particle comprising a core layer of color resin particle prepared through the polymerization step and a shell layer which is different from the core layer and deposited on the outer side thereof. In the core-shell type color resin particle, a core layer made of a substance having a low softening point is coated with a substance having a softening point higher than that. Thereby, storage stability and low-temperature fixing property of the obtained toner can be further increased.

The core-shell type color resin particle can be produced by any known traditional method. Preferred are in situ polymerization and phase separation from the viewpoint of production efficiency.

A method of producing the core-shell type color resin particle by in situ polymerization will now be described.

In the case of in situ polymerization, a polymerizable monomer for forming a shell layer (polymerizable monomer for a shell) and a polymerization initiator for a shell are added to the aqueous dispersive medium having color resin particle dispersed therein, followed by polymerization. Thereby, the core-shell type color resin particle can be prepared.

The polymerizable monomer for a shell to be used can be the same polymerizable monomer as described above. Among these, it is preferred that monomers (such as styrene and methyl methacrylate) which can provide a polymer having a Tg more than 80° C. be used alone or in combination.

Examples of the polymerization initiator for a shell used in polymerization of the polymerizable monomer for a shell include polymerization initiators such as persulfuric acid metal salts such as potassium persulfate and ammonium persulfate; water-soluble azo compounds such as 2,2'-azobis (2-methyl-N-(2-hydroxyethyl)propionamide), and 2,2'-azo-bis-(2-methyl-N-(1,1-bis(hydroxymethyl)2-hydroxyethyl) propionamide); and the like. The amount of the polymerization initiator for a shell to be used is preferably 0.1 to 30 parts by mass, more preferably 1 to 20 parts by mass with respect to 100 parts by mass of the polymerizable monomer for a shell.

The polymerization temperature of the shell layer is preferably 50° C. or more, more preferably 60 to 95° C. The polymerization time of the shell layer is preferably 1 to 20 hours, more preferably 2 to 15 hours.

(A-4) Washing, Filtration, Dehydration, and Drying Steps

After the end of polymerization, it is preferred that the aqueous dispersion of the color resin particle prepared through (A-3) polymerization step above be repeatedly, as needed, subjected to a series of operations of washing, filtration, dehydration, and drying according to a normal method.

First, to remove the residual dispersion stabilizer in the aqueous dispersion of the color resin particle, it is preferred that the aqueous dispersion of the color resin particle be washed by adding an acid or an alkali. If the dispersion stabilizer used is an inorganic compound soluble to acids, washing is preferably performed by adding an acid to the aqueous dispersion of the color resin particle. If the dispersion stabilizer used is an inorganic compound soluble to alkalis, washing is preferably performed by adding an alkali to the aqueous dispersion of the color resin particle.

If an inorganic compound soluble to acids is used as the dispersion stabilizer, it is preferred that an acid be added to the aqueous dispersion of the color resin particle to adjust the pH to preferably 6.5 or less, more preferably 6 or less. The acid to be added can be inorganic acids such as sulfuric acid, hydrochloric acid, and nitric acid, and organic acids such as formic acid and acetic acid. Particularly suitable is sulfuric acid because of its great efficiency in removing the dispersion stabilizer and a small load to production facilities.

Various known methods and the like can be used for the method of dehydration and filtration, and there is no particular limitation. Examples thereof include a centrifugal filtration method, a vacuum filtration method, and a pressure filtration method. Also, the method of drying is not particularly limited, and various methods can be used.

(B) Pulverization Method

If the pulverization method is used, the color resin particle is produced by the following process.

First, the binder resin, the colorant, the charge control agent, the release agent, and the additive having the polydiene structure, and further, if necessary, other additives to be added, are mixed using a mixer, such as a ball mill, a V type mixer, a Henschel mixer (trade name), a high speed dissolver, an internal mixer, or a Forberg mixer. In the next step, the resulting mixture is kneaded under heating using a pressure kneader, a twin-screw extrusion kneader, a roller, or the like. The kneaded product is crushed using a mill such as a hammer mill, a cutter mill, a roller mill, or the like. Furthermore, the product is pulverized using a mill such as a jet mill, a high speed rotary mill, or the like, and is classified into a desired particle size with a classifier such as an air classifier, an air stream classifier, or the like. Thus, color resin particle can be prepared by the pulverization method.

Note that, the binder resin, the colorant, the charge control agent, the release agent, and the additive having the polydiene structure, and further, if necessary, other additives to be added used in the pulverization method can be the same as those listed in (A) suspension polymerization method above. Moreover, the color resin particle prepared by the pulverization method can be formed into the core-shell type color resin particle by a method such as in situ polymerization as in the color resin particle prepared by (A) suspension polymerization method above.

Note that, as the binder resin, a resin widely used in a toner conventionally can be used in addition to the above-described binder resin. Specific examples of the binder resin used in the pulverization method include polystyrene, a styrene-butyl acrylate copolymer, a polyester resin, and an epoxy resin.

(Color Resin Particle)

The color resin particle is obtained by the above-described (A) suspension polymerization method or (B) pulverization method.

The color resin particle constituting the toner will be described below. Note that, the color resin particle described below include both of those of the core-shell type and those of the non-core-shell type.

As for the color resin particle used in the first aspect of the present invention, as the crystal domain of the release agent contained in the color resin particle, those having a specific shape are included in a specific number. That is, when the cross-section of the color resin particle is observed by a transmission electron microscope (TEM), the number of crystal domains of the release agent having an aspect ratio in the range of 2 to 10 in the field of view of 2 μm×2 μm square of the cross-section of the color resin particle is in the range of 2 to 30. In the first aspect of the present invention, by finely dispersing the release agent contained in the color resin particle in a state having a crystal domain structure in which the aspect ratio is 2 to 10, and by setting the number of the crystal domains in the range of 2 to 30 in the field of view of 2 μm×2 μm square, the effect of improving the low-temperature fixing property by adding the release agent can be sufficiently achieved while effectively suppressing blocking of the obtained toner. As a result, the obtained toner can be made excellent in storage stability and low-temperature fixing property.

In a 2 μm×2 μm square field of view, the number of crystal domains of the release agent in which the aspect ratio is in the range of 2 to 10 is 2 to 30, preferably 3 to 27, and more preferably 5 to 25. In the first aspect of the present invention, the number of crystal domains of the release agent having the aspect ratio in the range of 2 to 10 may be in the above range, but from the viewpoint of further enhancing the effect of the present invention, it is preferable that the number of crystal domains of the release agent having the aspect ratio in the range of 3 to 8 in the field of view of 2 μm×2 μm square is also in the above range.

The number of crystal domains of the release agent having the aspect ratio in the range of 2 to 10 and the number of crystal domains of the release agent having the aspect ratio in the range of 3 to 8 in the field of view of 2 μm×2 μm square can be measured, for example, by the following method. That is, first, the color resin particle is dispersed in an epoxy resin and cured, cooled to a temperature of −80° C., and then cut with a microtome to produce a thin piece. Then, the thin piece was stained with ruthenium tetraoxide aqueous solution vapor, and observed by a transmission electron microscope (TEM), the number of crystal domains of the release agent and the aspect ratio of the crystal domain of the release agent present in the field of view of 2 μm×2 μm square of cross section of the color resin particle are calculated by image analysis. Thus, the number of crystal domains of the release agent having the aspect ratio in the range of 2 to 10 and the number of crystal domains of the release agent having the aspect ratio in the range of 3 to 8 can be obtained. In these measurements, observations are made over a visual field range that is sufficiently wider than 2 μm×2 μm square (for example, a visual field range in which five or more color resin particles can be observed in cross section). In this visual field range, the number of crystal domains of the release agent having the aspect ratio in the range of 2 to 10 and the number of crystal domains of the release agent having the aspect ratio in the range of 3 to 8 are calculated, and the number of crystal domains present in the visual field range of 2 μm×2 μm square can be converted from the obtained calculation results, and this can be used as a measurement value.

Note that, the method of setting the number of crystal domains of the release agent having the aspect ratio in the range of 2 to 10 within the above range is not particularly limited, and examples thereof include a method in which the additive having the polydiene structure is contained in the color resin particle. Specifically, by containing the additive having the polydiene structure, the release agent can be appropriately dispersed in the color resin particle by compatibility of the additive having the polydiene structure with the release agent, so that the number of the crystal domains of the release agent having the aspect ratio in the range of 2 to 10 can be set within the above range. In addition, in the first aspect of the present invention, a method of controlling the number of present crystal domains of the release agent having the aspect ratio in a range of 2 to 10 within the above range is not particularly limited, and examples thereof include methods of adjusting a type of the additive having the polydiene structure to be used, a type of the release agent to be used, an amount of the additive having the polydiene structure to be used, and an amount of the release agent to be used, and the like, and these may be combined.

Further, the average value of the aspect ratio of the crystal domains of the release agent contained in the color resin particle is not particularly limited, but is preferably 2 to 10, more preferably 3 to 9, and still more preferably 3.5 to 8.5. Also, the average major axis (average value of the major axis) of the crystal domains of the release agent is preferably 0.20 to 1.0 μm, more preferably 0.25 to 0.90 μm, and the average minor axis (average value of the minor axis) of the crystal domains of the release agent is preferably 0.03 to 0.15 μm, more preferably 0.04 to 0.10 μm. By setting the average value of the aspect ratio, the average major axis, and the average minor axis of the crystal domain of the release agent to each of the above ranges, the effect of improving the storage stability and the low-temperature fixing property can be further enhanced. The average value of the aspect ratio, the average major axis, and the average minor axis of the crystal domains of the release agent can be obtained by, when the measurement for the number of crystal domains of the release agent having the aspect ratio in the range of 2 to 10 and the number of crystal domains of the release agent having the aspect ratio in the range of 3 to 8 is performed, measuring the aspect ratio, major axis, and minor axis of each of the crystal domains of the release agent to be measured, and calculating the average value of the crystal domains of all the release agents to be measured.

The volume average particle diameter Dv of the color resin particle is preferably 3 to 15 μm, more preferably 4 to 12 μm, and still more preferably 5 to 8 μm from the viewpoint of image reproducibility. When the volume average particle diameter Dv of the color resin particle is less than the above range, the fluidity of the toner may be lowered, and the image quality may be easily deteriorated due to fogging or the like. On the other hand, when the volume average particle diameter Dv of the color resin particle exceeds the above range, the resolution of the obtained image may be lowered.

In addition, the particle size distribution (Dv/Dn), which is a ratio of the volume average particle diameter (Dv) and the number average particle diameter (Dn) of the color resin particle, is preferably 1.00 to 1.30, more preferably 1.00 to 1.20, from the viewpoint of image reproducibility. When the particle size distribution (Dv/Dn) of the color resin particle exceeds the above ranges, the fluidity of the toner may be lowered, and the image quality of the color resin particle may be easily deteriorated due to fogging or the like. The volume average particle diameter Dv and the number average particle diameter Dn of the color resin particle can be measured using, for example, a particle size analyzer (manufactured by Beckman Coulter, trade name: Multisizer).

In addition, the average circularity of the color resin particle described above is preferably 0.960 to 1.000, more preferably 0.970 to 1.000, and still more preferably 0.980 to 1.000 from the viewpoint of image reproducibility.

In addition, the gel content (tetrahydrofuran insoluble content) of the color resin particle described above is preferably 1 to 50% by weight, more preferably 5 to 47% by weight, still more preferably 10 to 45% by weight, and particularly preferably 15 to 40% by weight, from the viewpoint of making the hot offset property and the low-temperature fixing property better.

The weight average molecular weight (Mw) of the color resin particle described above is preferably 20,000 to 200,000, more preferably 30,000 to 180,000, still more preferably 35,000 to 150,000, and particularly preferably 40,000 to 90,000.

The color resin particle described above may be used as a toner as it is or as a mixture of the color resin particle and carrier particle (such as ferrite and iron powder). To adjust the charging property, fluidity, storage property, and the like of the toner, using a high speed stirrer (such as trade name: FM mixer (manufactured by Nippon Coke & Engineering Co., Ltd.)), an external additive may be added to and mixed with the color resin particle to prepare a one-component toner. Furthermore, the color resin particle and an external additive may be mixed further with carrier particle to prepare a two-component toner.

Stirrers used for external processing are not particularly limited if they are stirrers capable of attaching external additive to the surface of color resin particle. For example, stirrers capable of mixing and agitating such as FM mixer (trade name, manufactured by Nippon Coke & Engineering Co., Ltd.), supermixer (trade name, manufactured by Kawada Seisakusho Co., Ltd.), Q mixer (trade name, manufactured by Nippon Coke & Engineering Co., Ltd.), mechanofusion system (trade name, manufactured by Hosokawa Micron Corporation), and mechanomill (trade name, Okada Seiko Co., Ltd.)

Examples of the external additive include inorganic fine particles of silica, titanium oxide, aluminum oxide, zinc oxide, tin oxide, calcium carbonate, calcium phosphate, cerium oxide, and the like; organic fine particles of polymethyl methacrylate resins, silicone resins, melamine resins, and the like. Among these, inorganic fine particles are preferred, silica and titanium oxide are more preferred, and silica is particularly preferred. It is preferred that a combination of two or more fine particles be used as the external additive. Note that, each of these external additives can be used alone, but two or more of them are preferably used in combination.

The external additive is preferably used in a proportion of 0.3 to 6 parts by mass, more preferably 1.2 to 3 parts by mass, with respect to 100 parts by mass of the color resin particle.

The toner according to the first aspect of the present invention comprises, as the color resin particle, those containing the binder resin, the colorant, the charge control agent, the release agent, and the additive having the polydiene structure in which solubility in styrene at a temperature of 40° C. is 3 to 40 g/100 g, and in which the number of crystal domains of a release agent having an aspect ratio in the range of 2 to 10 in the field of view of 2 μm×2 μm square of the cross-section of the color resin particle by transmission electron microscopy (TEM) observation is 2 to 30, and according to the toner of the first aspect of the present invention, the toner is excellent in storage stability and low-temperature fixing, and therefore, can sufficiently meet the requirements for reduction of energy consumption and high speed printing in recent years.

<Toner for Electrostatic-Image Development According to the Second Aspect>

Further, a toner for electrostatic-image development according to the second aspect of the present invention is a toner for electrostatic-image development comprising a color resin particle containing a binder resin, a colorant, a charge control agent, a release agent, and an additive having a polydiene structure, wherein the additive having the polydiene structure has a solubility in styrene at a temperature of 40° C. of 3 to 40 g/100 g, and a storage modulus G'(60) of the color resin particle at 60° C., which is determined by dynamic viscoelasticity measurement, is $1.6\times10^8$ to $5.0\times10^8$ Pa.

The color resin particle constituting the toner according to the second aspect of the present invention can be produced by any of a dry method such as a pulverizing method, or a wet method such as an emulsion polymerization aggregation method, a dispersion polymerization method, a suspension polymerization method, and a dissolution suspension method as in the toner according to the first aspect described above, but are preferably produced by a wet method because a toner having excellent printing characteristics such as image reproducibility is easily obtained. In addition, the color resin particle constituting the toner according to the second aspect of the present invention are produced by the same process as in the case of the toner according to the first aspect described above, when the color resin particle is produced by employing (A) suspension polymerization method which is a preferred method among the wet methods, or by employing (B) pulverization method which is a representative method among the dry methods.

When the color resin particle constituting the toner according to the second aspect of the present invention is obtained by (A) suspension polymerization method, as in the case of the toner according to the first aspect described above, it can be produced by passing through (A-1) preparation step of the polymerizable monomer composition, (A-2) suspending step (droplet forming step) to obtain a suspension, (A-3) polymerization step, and (A-4) washing, filtration, dehydration, and drying steps. In this case, as the raw material used for producing the color resin particle, such as a polymerizable monomer, a colorant, a charge control agent, a release agent, and an additive having a polydiene structure, and further other additives used if necessary, the same material as in the case of the toner according to the first aspect described above can be used, and the production conditions thereof can be the same.

Also, when the color resin particle constituting the toner according to the second aspect of the present invention is obtained by (B) pulverization method, it can be produced by the same method as in the case of the toner according to the first aspect described above, and the same material as in the case of the toner according to the first aspect described above can be used as a raw material used for producing the color resin particle, and the production conditions thereof can be the same.

Although the color resin particle constituting the toner according to the second aspect of the present invention can be produced, for example, by the above-described (A) suspension polymerization method or (B) pulverization method, in the second aspect of the present invention, the color resin particle where the storage modulus G'(60) at 60° C., which is determined by dynamic viscoelasticity measurement, is controlled in a range of $1.6\times10^8$ to $5.0\times10^8$ Pa is used. The storage modulus G'(60) at 60° C. determined by dynamic viscoelasticity measurement of the color resin particle is controlled within the above range, whereby the effect of improving the low-temperature fixing property by adding a release agent can be sufficiently achieved while effectively suppressing blocking of the obtained toner. As a result, the obtained toner can be made excellent in storage stability and low-temperature fixing property.

The storage modulus G'(60) at 60° C., determined by dynamic viscoelasticity measurement of the color resin particle, may be in the range of $1.6\times10^8$ to $5.0\times10^8$ Pa, but preferably in the range of $1.8\times10^8$ to $4.5\times10^8$ Pa, more preferably in the range of $2.0\times10^8$ to $4.0\times10^8$ Pa.

In the second aspect according to the present invention, the storage modulus G'(60) at 60° C. of the color resin particle obtained by the dynamic viscoelasticity measurement may be in the above range, but from the viewpoint of making the obtained toner more excellent in storage stability and low-temperature fixing property, the storage modulus G'(100) at 100° C. of the color resin particle obtained by the dynamic viscoelasticity measurement is preferably controlled in the range of $1.0\times10^5$ to $3.0\times10^5$ Pa, more preferably in the range of $1.1\times10^5$ to $2.9\times10^5$ Pa, and more preferably in the range of $1.2\times10^5$ to $2.8\times10^5$ Pa.

The ratio G'(60)/G'(100) of the storage modulus G'(60) at 60° C. to the storage modulus G'(100) at 100° C. determined by the dynamic viscoelasticity measurement is not particularly limited, but from the viewpoint of making the obtained toner more excellent in storage stability and low-temperature fixing property, it is preferable that G'(60)/G'(100) is controlled in the range of $1.0\times10^3$ to $5.0\times10^3$, more preferable that G'(60)/G'(100) is controlled in the range of $1.0\times10^3$ to $4.0\times10^3$, and still more preferable that G'(60)/G'(100) is controlled in the range of $1.0\times10^3$ to $3.0\times10^3$.

The method of measuring the storage modulus G'(60) at 60° C. and the storage modulus G'(100) at 100° C. of the color resin particle is not particularly limited, but it can be measured by using a measurement sample where the color resin particle is held in a load of 20 g in a pair of plates of 8 mm phi (each of the color resin particle is arranged uniformly with respect to an area of 8 mm phi and are held in a load of 20 g in a pair of plates) and performing dynamic viscoelasticity measurement using a dynamic viscoelasticity measurement device which has a rotating plane type rheometer at measurement frequency of 24 Hz, a temperature rising rate of 5° C./min, a temperature range of 45 to 150° C.

In addition, in the second aspect according to the present invention, a method of setting the storage modulus G'(60) at 60° C. of the color resin particle, and further, the storage modulus G'(100) at 100° C. of the color resin particle within the above range, is not particularly limited, and examples thereof include a method in which the additive having the polydiene structure is contained in the color resin particle. Specifically, by containing the additive having the polydiene structure, the release agent can be appropriately dispersed in the color resin particle by compatibility of the additive having the polydiene structure with the release agent, whereby the storage modulus G'(60) at 60° C. of the color resin particle and the storage modulus G'(100) at 100° C. of the color resin particle can be set within the above range. Further, in the first aspect according to the present invention, the method of further controlling the storage modulus G'(60) at 60° C. of the color resin particle in the range of $1.6\times10^8$ to $5.0\times10^8$ Pa is not particularly limited, but examples thereof include methods of adjusting a type of the additive having the polydiene structure to be used, a type of the release agent to be used, an amount of the additive having the polydiene structure to be used, and an amount of the release agent to be used, and the like, and these may be combined. Similarly, a method of further controlling the storage modulus G'(100) at 100° C. of the color resin particle in the range of $1.0\times10^5$ to $3.0\times10^5$ Pa is not particularly limited, but examples thereof include methods of adjusting a type of the additive having the polydiene structure to be used, a type of the release agent to be used, an amount of the additive having the polydiene structure to be used, and an amount of the release agent to be used, and the like, and these may be combined.

The volume average particle diameter (Dv), the number average particle diameter (Dn), the particle diameter distribution (Dv/Dn), and the average circularity of the color resin particle are preferably in the same range for the same reason as those of the color resin particle according to the first aspect described above.

Further, it is preferable that the gel content (tetrahydrofuran insoluble content) and the weight average molecular weight (Mw) of the color resin particle described above be in the same range for the same reason as those of the color resin particle according to the first aspect described above.

The color resin particle described above may be used as a toner as it is or as a mixture of the color resin particle and carrier particle (such as ferrite and iron powder). To adjust the charging property, fluidity, storage property, and the like of the toner, using a high speed stirrer (such as trade name: FM mixer (manufactured by Nippon Coke & Engineering Co., Ltd.)), an external additive may be added to and mixed with the color resin particle to prepare a one-component toner. Furthermore, the color resin particle and an external additive may be mixed further with carrier particle to prepare a two-component toner. As the stirrer for performing the external addition treatment, the same stirrer as in the above-described first aspect can be used, and as the external additive, the same external additive as in the above-described first aspect can be used in the same ratio.

The toner according to the second aspect of the present invention include the additive having the polydiene structure in which solubility in styrene at a temperature of 40° C. is 3 to 40 g/100 g, and the storage modulus G'(60) at 60° C. of the color resin particle is controlled to a range of $1.6\times10^8$ to $5.0\times10^8$ Pa. According to the toner of the second aspect of the present invention, the toner is excellent in storage stability and low-temperature fixing, and therefore, can sufficiently meet the requirements for reduction of energy consumption and high speed printing in recent years.

EXAMPLES

Hereinafter, the present invention will be more specifically described by way of Examples and Comparative Examples, but the present invention will not be limited only to these Examples. Note that, "part(s)" and "%" are mass-based unless otherwise specified.

The test methods performed in Examples and Comparative Examples are as described below.

(1) Weight Average Molecular Weight of Conjugated Diene-Aromatic Vinyl-Based Thermoplastic Elastomer The weight average molecular weight was determined as a molecular weight in terms of polystyrene by high performance liquid chromatography using tetrahydrofuran having a flow rate of 0.35 ml/min as a carrier. The device used was a HLC8320 manufactured by Tosoh, a column connected with three Shodex (registered trademark) KF-404HQ manufactured by Showa Denko K. K. (column temperature: 40° C.), a differential refractometer and an ultraviolet detector as detectors, and the molecular weight was calibrated at 12 points of standard polystyrenes (500 to 3 million) manufactured by Polymer Laboratories Ltd.

(2) Content of Each Block Copolymer in Conjugated Diene-Aromatic Vinyl-Based Thermoplastic Elastomer It was determined from the area ratio of the peak corresponding to each block copolymer of the chart obtained by high performance liquid chromatography described above.

(3) Weight Average Molecular Weight of Styrene Polymer Block of Block Copolymer Constituting Conjugated Diene-Aromatic Vinyl-Based Thermoplastic Elastomer According to the process described in Rubber Chem. Technol., 45, 1295 (1972), the block copolymer was reacted with ozone and reduced with lithium aluminum hydride to decompose the isoprene polymer block of the block copolymer. Specifically, the following procedure was performed. That is, 300 mg of the sample was dissolved in a reaction vessel containing 100 ml of dichloromethane treated with molecular sieves. This reaction vessel was placed and cooled to −25° C. in a cooling tank, and ozone generated by an ozone generator was introduced while oxygen was flowed into the reaction vessel at a flow rate of 170 ml/min. After 30 minutes from the start of the reaction, it was confirmed that the reaction was completed by introducing the gas flowing out of the reaction vessel into the aqueous potassium iodide solution. Then, 50 ml of diethyl ether and 470 mg of lithium aluminum hydride were charged into another reaction vessel subjected to nitrogen substitution, and a solution reacted with ozone was slowly added dropwise to this reaction vessel while cooling the reaction vessel with ice water. Then, the reaction vessel was placed in a water bath, and the temperature was gradually increased to reflux at 40° C. for 30 minutes. Thereafter, while stirring the solution, dilute hydrochloric acid was added dropwise in small portions to the reaction vessel, and dropping was continued until the generation of hydrogen was hardly recognized. After this reaction, the solid product formed in the solution was filtered off and the solid product was extracted with 100 ml of diethyl ether for 10 minutes. The extract was combined with the filtrate after filtration, and the solvent was distilled off to obtain a solid sample. With respect to the sample thus obtained, the weight average molecular weight was measured according to the method of measuring the weight average molecular weight described above, and the value thereof was defined as the weight average molecular weight of the styrene polymer block.

(4) Weight Average Molecular Weight of Isoprene Polymer Block of Block Copolymer Constituting Conjugated Diene-Aromatic Vinyl-Based Thermoplastic Elastomer From the weight average molecular weight of the block copolymer determined as described above, the weight average molecular weight of the corresponding styrene polymer block was subtracted, and the weight average molecular weight of the isoprene polymer block was determined based on the calculated value.

(5) Styrene Unit Content of Block Copolymer Constituting Conjugated Diene-Aromatic Vinyl-Based Thermoplastic Elastomer It was determined based on the detection intensity ratio between the differential refractometer and the ultraviolet detector in the measurement of the high performance liquid chromatography. Note that, in advance, copolymers having different styrene unit contents were prepared, and using them, a calibration curve was prepared.

(6) Vinyl Bond Content of Isoprene Polymer Block of Block Copolymer Constituting Conjugated Diene-Aromatic Vinyl-Based Thermoplastic Elastomer It was determined based on the measurement of proton NMR.

(7) Styrene Unit Content of Conjugated Diene-Aromatic Vinyl-Based Thermoplastic Elastomer It was determined based on the measurement of proton NMR.

(8) Melt Index of Conjugated Diene-Aromatic Vinyl-Based Thermoplastic Elastomer

It was measured according to ASTM D1238 (G-condition, 200° C., 5 kg load).

(9) Volume Average Particle Diameter (Dv) of Color Resin Particle

About 0.1 g of the color resin particle was weighed, the weighed color resin particle was taken into a beaker, and 0.1 mL of a surfactant solution (trade name: dry well, manufactured by Fujifilm Corporation) was added as a dispersant. After adding 10 to 30 mL of Isoton II to that beaker and dispersing it in an ultrasonic disperser of 20 W for 3 minutes, the volume averaged particle size (Dv) of color resin particle was measured using a particle size measurement device (Beckman Coulter, Inc., trade name: Multisizer) under a condition of an aperture diameter: 100 μm, medium: Isotone II, number of measured particles: 100,000.

(10) Gel Content of Color Resin Particle 1.0 g of the color resin particle was weighed and placed in a Soxhlet extractor containing a cylindrical filter paper (manufactured by Advantec Toyo Kaisha, Ltd., No. 86R, size 28×100 mm), and it was refluxed for 5 hours using 100 ml of tetrahydrofuran (THF) as a solvent to obtain an extract. The THF was distilled off from the extract to obtain a nonvolatile component, which was dried under vacuum at 50° C. for 1 hour, and then precisely weighed and calculated from the following calculation formula.

$$\text{THF insoluble content (\%)}=[(T-S)/(T)]\times 100$$

T: Sample amount of the color resin particle (g)

S: Amount of extracted nonvolatile components (g)

(11) Weight Average Molecular Weight (Mw) of Color Resin Particle

Each of 0.1 g of color resin particle which was color resin particle was placed in a 100 mL glass sample bottle, and then 49.9 g of tetrahydrofuran (THF) was added, respectively. Next, a starler chip was placed, stirred at room temperature for 1 hour using a magnetic stirrer, and then filtered through a 0.2 μm PTFE filter to obtain a THF solution of colored plastic particle. Finally, 100 μL of each of the THF solutions was injected into the GPC measurement device for GPC measurement. The weight average molecular weight (Mw) was converted from a calibration curve by a commercially available monodisperse standard polystyrene based on the elution curve of the obtained GPC.

(GPC Measurement Conditions)

GPC: HLC-8220 (manufactured by Tosoh)

Columns: TSK-GEL MULTIPORE HXL-M 2 direct connection (manufactured by Tosoh)

Eluent: THF

Flow rate: 1.0 mL/min

Temperature: 40° C.

(12) Melting Temperature (T½) of Color Resin Particle

The melting temperature (T½) in the ½ method of color resin particle was calculated from the melt viscosity using a flow tester. Specifically, melt viscosities were measured using a flow tester (manufactured by Shimadzu Corporation, trade name: CFI-500C) under the conditions of a predetermined starting temperature, a heating rate, a preheating time, and shearing stresses. Then, from the obtained melt viscosities, the melt temperatures (T½) in the ½ method were obtained.

Starting temperature: 40° C., heating rate: 3° C./min, preheating time: 5 min, cylinder pressure: 10 kgf/cm$^2$, die diameter: 0.5 mm, die length: 1.0 mm

(13) Average Aspect Ratio, Average Major Axis, Average Minor Axis, Number of Crystal Domains of Release Agent Having Aspect Ratio in Range of 2 to 10, and Number of Crystal Domains of Release Agent Having Aspect Ratio in Range of 3 to 8

The color resin particles were dispersed in an epoxy resin and cured, then cooled to a temperature of −80° C., and cut by a microtome to produce a thin piece. Then, the prepared thin piece was stained for about 5 minutes with 0.5% concentration of ruthenium tetraoxide aqueous vapor, and observation by transmission electron microscopy (TEM) was performed for stained thin piece. Incidentally, in preparing the thin piece as a measurement sample, the concentration of the color resin particle in the thin piece was prepared to a concentration in the range of 28 μm×35 μm (magnification of 5,000 to 6,000) so that 5 to 10 cross sections can be observed. Then, a measurement image in a visual field range of 28 μm×35 μm was obtained, and in the obtained measurement image, five or more color resin particles to be evaluated were specified after excluding from the evaluation those in which the whole image of the cross section of the color resin particle was not displayed and color resin particle which deviated from the range of 0.6 to 1.2 times as compared with the volume average particle diameter (Dv). Then, for the specified color resin particle, the number of crystal domains of the release agent, the aspect ratio, major axis and minor axis of the crystal domains of the release agent were calculated by image analysis, and the average value of the aspect ratio, average major axis and average minor axis of the crystal domains of the release agent, the number of crystal domains of the release agent having the aspect ratio in the range of 2 μm to 10 in the visual field range of 2 μm×2 μm square, and the number of crystal domains of the release agent having the aspect ratio in the range of 3 to 8 in the visual field range of 2 μm×2 μm square were obtained using the calculated results. The number of crystal domains of the release agent having the aspect ratio in the range of 2 to 10 and the number of crystal domains of the release agent having the aspect ratio in the range of 3 to 8 were obtained by converting the number of crystal domains of the release agent which was measured into the number of crystal domains in the visual field range of 2 μm×2 μm square from the above calculation results.

(14) Storage Modulus G'(60) at 60° C. and Storage Modulus G'(100) at 100° C. of Color Resin Particle The measurement sample was prepared by holding the color resin particle in a load of 20 g in a pair of plates of 8 mm phi (each of the color resin particle was arranged uniformly with respect to an area of 8 mm phi and are held in a load of 20 g in a pair of plates) and dynamic viscoelasticity measurement was performed using a dynamic viscoelasticity measurement device (product name "ARES-G2", manufactured by TA Instruments) which had a rotating plane type rheometer at measurement frequency of 24 Hz, a load of 20 g, a temperature rising rate of 5° C./min, a temperature range of 45 to 150° C.

(15) Evaluation of Storage Property of Toner

After 10 g of toner was placed in a 100 mL polyethylene container and sealed, the container was submerged in a constant temperature water bath set at a predetermined temperature, and was taken out after 8 hours had elapsed. The toner was transferred on the screen of 42 meshes from the container which was taken out so as not to give vibration as much as possible, it was set on a powder measurement device (manufactured by Hosokawa Micron Corporation, trade name: powder tester PT-R). The amplitude of the sieve was set to 1.0 mm, and after the sieve was vibrated for 30 seconds, the mass of the toner remaining on the sieve was measured, which was taken as the mass of the aggregated toner. The maximum temperature (° C.) at which the mass of the agglomerated toners was 0.5 g or less was determined as the storage property temperature, and was used as an index of the storage property.

(16) Minimum Fixing Temperature of Toner

A fixing test was carried out using a commercially available nonmagnetic single component development printer (printing speed of 20 ppm) which was modified so that the temperature of the fixing roll part of could be changed. The fixing test was carried out by printing a solid black (100% printing density) and changing the temperature of the fixing roll of the modified printer by 5° C., measuring the fixing rate of the toner at each temperature, and obtaining the relationship between the temperature and the fixing rate. The fixing rate was calculated from the ratio of the image density before and after tape peeling by performing tape peeling in a printing region of black solid (printing density 100%). In other words, assuming that the image density before tape peeling is an ID (before) and the image density after tape peeling is an ID (after), the fixing ratio can be calculated by the following calculation formula.

$$\text{Fixation ratio (\%)}=(\text{ID (after)}/\text{ID (before)})\times 100$$

Here, the tape peeling operation was a series of operations in which an adhesive tape (manufactured by Sumitomo 3M Limited, trade name: Scotch-Mending Tape 810-3-18) was attached to a measurement portion of a test paper, the adhesive tape was adhered by pressing at a constant pressure, and then the adhesive tape was peeled in a direction along the paper at a constant speed. Further, the image density was measured using a reflectance type image densitometer (trade name: RD914, manufactured by Macbeth Co., Ltd.)

In this fixing test, the minimum fixing temperature of the fixing roll having a fixing ratio exceeding 80% was defined as the minimum fixing temperature of the toner.

(17) Hot Offset Occurring Temperature of Toner

A hot offset test was carried out using a commercially available nonmagnetic single component development printer (printing speed of 20 ppm) which was modified so that the temperature of the fixing roll part of could be changed. In the hot offset test, the temperature of the fixing roll part was changed from 150° C. to 220° C. by 5° C., and the solid image of 5 cm square was printed on a paper (Xerox Corporation, trade name: Vitarity), and the presence or absence of hot offset phenomena was confirmed by visually observing whether the fusing of toners was occurring in the fixation roll or not.

In this hot offset test, the lowest set temperature at which the fusing of the toner to the fixing roll has occurred was defined as the hot offset occurring temperature.

(18) Charge Amount of Toner

A cartridge filled with toner left in the environment of normal temperature and normal humidity (23° C., 50% RH) for one day was attached to a commercially available nonmagnetic single component development printer (printing speed of 20 ppm), then the charge amount (μC/g) of the toner was evaluated in an environment of normal temperature and normal humidity (23° C., 50% RH). First, white solid printing were performed on two sheets, and thereafter, the amount of charge (μC/g) of the toners adhering to the developing roll was measured using a suction-type charge amount measurement device (manufactured by Trek Japan Corporation, product name: 210 HS-2A). The charge amount of the toner was evaluated for Examples 4-1 to 4-4 and Comparative Examples 4-1 to 4-3.

(19) Bleeding Rate

The toner was stored in an environment at a temperature of 40° C. for 30 days, and the bleed rate of the toner after storage was measured. Specifically, the toner after storage for 30 days was observed by SEM, about 100 toner particles were evaluated for the presence or absence of bleeding of the release agent, and the proportion of the toner particles in which bleeding occurred was defined as the bleeding rate (unit: %). Evaluation of bleeding rate was performed for Examples 4-1 to 4-4 and Comparative Examples 4-1 to 4-3.

(20) Evaluation of Jetting

Using a commercially available nonmagnetic single component development printer (printing speed of 20 ppm), the toner cartridge of the developing device was filled with the toner, and then the toner cartridge filled with the toner was left at a condition of 40° C. for 30 days, and then the removed cartridge was set in the printer, and continuous printing was performed under the conditions of temperature: 32.5° C., humidity: 80%. Printing was performed at a halftone image density of 30%. Then, after the start of continuous printing, the presence or absence of a spout of toner from the toner cartridge to the printing paper (presence or absence of a spot of 0.3×0.3 mm or more due to the toner on the halftone) was confirmed every time. The longer the time that the toner was not spouted from the toner cartridge to the printing paper, the higher the effect of suppressing the spouting. The evaluation of jetting was carried out for Examples 4-1 to 4-4 and Comparative Examples 4-1 to 4-3.

(21) Sticking Material to Blade

Using a commercially available nonmagnetic single component development printer (printing speed of 20 ppm), the toner cartridge of the developing device was filled with the toner, and then the toner cartridge filled with toner was left at a condition of 40° C. for 30 days, and then, the presence or absence of adhesion of the sticking material to the blade (the blade defining the toner layer) was confirmed. Evaluation of sticking material on to the blade was carried out for Examples 4-1 to 4-4 and Comparative Examples 4-1 to 4-3.

Production Example 1

To the pressure-resistant reactor, 23.2 kg of cyclohexane, 1.5 mmol of N,N,N',N'-tetramethylethylenediamine (hereinafter, referred to as TMEDA) and 1.70 kg of styrene were added, and 99.1 mmol of n-butyllithium was added where the mixture was stirred at 40° C., and the mixture was polymerized for 1 hour while raising the temperature to 50° C. The polymerization conversion rate of styrene was 100% by mass. Subsequently, 6.03 kg of isoprene was continuously added to the reactor over a period of 1 hour while the temperature was controlled to keep the temperature between 50 and 60° C. After completion of the addition of isoprene, the mixture was further polymerized for 1 hour to form a styrene-isoprene diblock copolymer B (copolymer B represented by Ar-D). The polymerization conversion rate of isoprene was 100%. Then, 15.0 mmol of dimethyldichlorosilane was added as a coupling agent to perform a coupling reaction for 2 hours to form a styrene-isoprene-styrene triblock copolymer (copolymer A represented by Ar-D-Ar). Thereafter, 198 mmol of methanol was added as a polymerization terminator and mixed well to stop the reaction, thereby obtaining a reaction solution containing the block copolymer composition (α1). A portion of the obtained reaction solution was taken out, and the weight average molecular weight, the content ratio, and the vinyl bond content of each block copolymer and the entire block copolymer composition were determined. The obtained results are shown in Table 1. Then, 0.3 parts of 2,6-di-tert-butyl-p-cresol was added and mixed as an antioxidant to 100 parts of the reaction solution thus obtained (containing 30 parts of the polymer component), and the mixed solution was dropped into hot water heated to 85 to 95° C. in small portions to volatilize the solvent to obtain a precipitate, and the precipitate was pulverized and dried by hot air at 85° C., thereby recovering the block copolymer composition (α1). For the obtained block copolymer composition (α1), the melt index was measured, and the obtained results are shown in Table 2. Further, when the solubility of the obtained block copolymer composition (α1) in styrene at a temperature of 40° C. was measured, it was found to be 20 g/100 g.

Production Example 2

The block copolymer composition (α2) of Production Example 2 was obtained in the same manner as in Production Example 1, except that the amounts of styrene, n-butyllithium, TMEDA, isoprene, dimethyldichlorosilane and methanol were changed as shown in Table 1, respectively, and measurement was performed in the same manner. Measurement results are shown in Table 2. Further, when the solubility of the obtained block copolymer composition (α2) in styrene at a temperature of 40° C. was measured, it was found to be 20 g/100 g.

Production Example 3

The block copolymer composition (α3) of Production Example 3 was obtained in the same manner as in Production Example 1, except that the amounts of styrene, n-butyllithium, TMEDA, isoprene, dimethyldichlorosilane and methanol were changed as shown in Table 1, respectively, and measurement was performed in the same manner. Measurement results are shown in Table 2. Further, when the solubility of the obtained block copolymer composition (α3) in styrene at a temperature of 40° C. was measured, it was found to be 20 g/100 g.

Production Example 4

The block copolymer composition (α4) of Production Example 4 was obtained in the same manner as in Production Example 1, except that the amounts of styrene, n-butyllithium, TMEDA, isoprene, dimethyldichlorosilane and methanol were changed as shown in Table 1, respectively, and measurement was performed in the same manner. Measurement results are shown in Table 2. Further, when the solubility of the obtained block copolymer composition (α4) in styrene at a temperature of 40° C. was measured, it was found to be 4 g/100 g.

Production Example 5

The block copolymer composition (α5) of Production Example 5 was obtained in the same manner as in Production Example 1, except that the amounts of styrene, n-butyllithium, TMEDA, isoprene, and methanol were changed as shown in Table 1 and tetramethoxysilane in the amount shown in Table 1 was used instead of dimethyldichlorosilane, and measurement was performed in the same manner. Measurement results are shown in Table 2. Note that, the block copolymer composition (α5) obtained in Production Example 5 contained a styrene-isoprene diblock copolymer B (copolymer B represented by Ar-D), a three-branched styrene-isoprene block copolymer C (copolymer C represented by $(Ar\text{-}D)_3X$), and a four-branched styrene-isoprene block copolymer D (copolymer D represented by $(Ar\text{-}D)_4X$). Further, when the solubility of the obtained block copolymer composition (α5) in styrene at a temperature of 40° C. was measured, it was found to be 2 g/100 g.

Production Example 6, Production Example of Acrylic Resin 200 parts of toluene were put into the reaction vessel, the inside of the reaction vessel was sufficiently replaced with nitrogen while stirring toluene, and then the temperature was raised to 90° C., and then a mixed solution of 95 parts of methyl methacrylate, 4.6 parts of n-butyl acrylate, 0.4 parts of acrylic acid, and 2.8 parts of t-butylperoxy-2-ethylhexanoate (trade name: perbutyl 0, manufactured by NOF Corporation) was dropped into the reaction vessel over 2 hours. Further, the polymerization was completed by holding under toluene reflux for 10 hours, after which the solvent was distilled and removed under reduced pressure. Thus, an acrylic resin (Tg: 70° C., acid value: 2.5, weight average molecular weight (Mw): 11000) was obtained.

Table 1

TABLE 1

| | Production Example | | | | |
|---|---|---|---|---|---|
| | 1 | 2 | 3 | 4 | 5 |
| Cyclohexane (kg) | 23.2 | 23.2 | 23.2 | 23.2 | 23.2 |
| TMEDA (mmol) | 1.5 | 1.4 | 1.1 | 1.5 | 2.1 |
| n-butyllithium (mmol) | 99.1 | 94.3 | 70.3 | 101.7 | 138.0 |
| Styrene (kg) [First stage of polymerization] | 1.70 | 1.39 | 1.28 | 1.2 | 1.24 |
| Isoprene (kg) [Second stage of polymerization] | 6.03 | 6.34 | 6.45 | 6.53 | 6.49 |
| Dimethyldichlorosilane (mmol) [After second stage of polymerization] | 15.0 | 21.2 | 7.7 | 37.6 | — |
| Tetramethoxysilane (mmol) [After second stage of polymerization] | — | — | — | — | 27.6 |
| Methanol (mmol) [After second stage of polymerization] | 198 | 189 | 141 | 203 | 276 |

TABLE 2

| | Production Example | | | | |
|---|---|---|---|---|---|
| Type | 1 (α1) | 2 (α2) | 3 (α3) | 4 (α4) | 5 (α5) |
| Styrene-isoprene-styrene triblock copolymer A | | | | | |
| Weight average molecular weight of styrene-isoprene-styrene triblock copolymer A | 218,000 | 230,000 | 308,000 | 220,000 | — |
| Weight average molecular weight of styrene block | 17,000 | 15,000 | 18,000 | 12,000 | — |
| Styrene unit content of styrene-isoprene-styrene triblock copolymer A [%] | 22 | 18 | 16.5 | 15.5 | — |
| Vinyl bond content of isoprene block [mol %] | 7 | 7 | 7 | 7 | — |
| Weight average molecular weight of isoprene block | 184,000 | 200,000 | 272,000 | 189,000 | — |
| Styrene-isoprene diblock copolymer B | | | | | |
| Weight average molecular weight of styrene-isoprene diblock copolymer B | 109,000 | 115,000 | 154,000 | 110,000 | 77,000 |
| Weight average molecular weight of styrene block | 17,000 | 15,000 | 18,000 | 12,000 | 9,000 |
| Styrene unit content of styrene-isoprene diblock copolymer B [%] | 22 | 18 | 16.5 | 15.5 | 16 |
| Vinyl bond content of isoprene block [mol %] | 7 | 7 | 7 | 7 | 7 |
| Weight average molecular weight of isoprene block | 92,000 | 100,000 | 136,000 | 98,000 | 68,000 |
| Three-branched styrene-isoprene block copolymer C | | | | | |
| Weight average molecular weight of three-branched styrene-isoprene block copolymer C | — | — | — | — | 231,000 |
| Styrene unit content of three-branched styrene-isoprene block copolymer C [%] | — | — | — | — | 16 |
| Vinyl bond content of isoprene block [mol %] | — | — | — | — | 7 |
| Four-branched styrene-isoprene block copolymer D | | | | | |
| Weight average molecular weight of four-branched styrene-isoprene block copolymer D | — | — | — | — | 308,000 |
| Styrene unit content of four-branched styrene-isoprene block copolymer D [%] | — | — | — | — | 16 |
| Vinyl bond content of isoprene block [mol %] | — | — | — | — | 7 |
| Entire block copolymer composition | | | | | |
| Weight average molecular weight of entire block copolymer composition | 142,000 | 166,000 | 188,000 | 192,000 | 192,000 |
| Styrene unit content [%] | 22 | 18 | 16.5 | 15.5 | 16 |
| Vinyl bond content of isoprene block [mol %] | 7 | 7 | 7 | 7 | 7 |
| Content ratio of styrene-isoprene-styrene triblock copolymer A [%] | 30 | 44 | 22 | 74 | 70 |
| Content ratio of styrene-isoprene diblock copolymer B [%] | 70 | 56 | 78 | 26 | — |
| Content ratios of three-branched and four-branched styrene-isoprene block copolymer C, D [%] | — | — | — | — | 30 |
| Melt index [g/10 min] G-condition | 10 | 17 | 10 | 16 | 20 |

Example 1-1

77 parts of styrene and 23 parts of n-butyl acrylate as a monovinyl monomer, 7 parts of carbon black (trade name: #25B, manufactured by Mitsubishi Chemical Corporation) as a colorant, 0.6 parts of divinylbenzene as a cross-linkable polymerizable monomer, 1.2 parts of t-dodecylmercaptan as a molecular weight adjusting agent, 0.3 parts of polymethacrylic ester macromonomer (trade name: AA6, Tg=94° C., manufactured by Toagosei Company, Limited) as a macromonomer, and 1 part of the acrylic resin obtained in Production Example 6 was subjected to wet grinding using a media type wet grinder, and then 1 part of a charge control resin (styrene/acrylic resin containing a quaternary ammonium salt as a functional group, copolymerization ratio of monomers containing a functional group of a quaternary ammonium salt of 2%) as a charge control agent, 20 parts of behenyl stearate (number average molecular weight (Mn): 592) as a release agent, and 5 parts of the block copolymer composition (α1) obtained in Production Example 1 as an additive having a polydiene structure were added and mixing to obtain a polymerizable monomer composition.

On the other hand, to an aqueous solution in which 7.4 parts of magnesium chloride (water-soluble polyvalent metal salt) was dissolved in 250 parts of ion-exchanged water, an aqueous solution in which 4.1 parts of sodium hydroxide (alkali metal hydroxide) was dissolved in 50 parts of ion-exchanged water was gradually added under stirring under room temperature to prepare colloid of a magnesium hydroxide dispersion (colloid of poorly water-soluble metal hydroxide).

On the other hand, 2 parts of methyl methacrylate as a polymerizable monomer for a shell and 65 parts of ion-exchanged water were subjected to a fine dispersion treatment by an ultrasonic emulsifier to obtain an aqueous dispersion of a polymerizable monomer for a shell.

To the colloid of magnesium hydroxide dispersion obtained by the above, the above polymerizable monomer composition was charged, stirred until the liquid droplets were stabilized, and 6 parts of t-butylperoxyisobutyrate (trade name: perbutyl IB, manufactured by NOF Corporation) was added as a polymerization initiator therein, followed by high shear stirring using an in-line emulsification disperser (trade name: milder, manufactured by Pacific Machinery & Engineering Co., Ltd.) at a rotational speed of 15,000 rpm, and dispersion treatment was performed while circulating to form droplets of the polymerizable monomer composition.

Next, 1 part of sodium tetraborate decahydrate was added to the aqueous dispersion including the polymerizable monomer composition in the state of droplet formation, and the mixture was placed in a reactor equipped with a stirring blade, and the temperature was raised to 85° C. to perform a polymerization reaction, and after the polymerization conversion rate reached almost 100%, an aqueous dispersion of the polymerizable monomer for a shell prepared above and 0.3 parts of 2,2'-azobis(2-methyl-N-(2-hydroxylethyl)-propionamide) (trade name: VA-086, water-soluble, manufactured by WAKO CHEMICAL, LTD.) as a polymerization initiator for a shell were added to the reactor. Further, after continuing the polymerization for 4 hours, the reaction was stopped by water cooling to obtain an aqueous dispersion of color resin particle having a core-shell structure.

To the above aqueous dispersion of the color resin particle, washing (25° C., 10 minutes) with dilute sulfuric acid was performed to bring the pH to 4.5 or less. Then, after separating water by filtration, 200 parts of ion-exchanged water was newly added and re-slurried, and the water washing treatment (washing, filtration and dehydration) was repeated several times at room temperature (25° C.), and the obtained solid content was filtered and separated, followed by vacuum drying to obtain dried color resin particle. The obtained color resin particle were measured according to the above method, including the measurement of the average aspect ratio, the average major axis, and the average minor axis of crystal domains of the release agent, the number of crystal domains of the release agent having an aspect ratio in the range of 2 to 10, the number of crystal domains of the release agent having an aspect ratio in the range of 3 to 8, the storage modulus G'(60) at 60° C., and the storage modulus G'(100) at 100° C. These results are shown in Table 3.

In addition, to the 100 parts of the color resin particle obtained above, 0.5 parts of silica microparticles having an average number of primary particle sizes of 7 nm and hydrophobicized with cyclic silazane, and 1 part of silica microparticles having an average number of primary particle sizes of 35 nm and hydrophobicized with amino-modified silicone oil were added and the external treatment was performed by mixing and stirring using a high-speed stirrer (manufactured by Nippon Coke & Engineering Co., Ltd., trade name: FM mixer) and so as to obtain a toner for electrostatic-image development. The above-described measurements were performed using the obtained toner for electrostatic-image development. The results are shown in Table 2.

Example 1-2

A color resin particle and a toner for electrostatic-image development of Example 1-2 were obtained in the same manner as in Example 1-1, except that 20 parts of stearyl stearate (number average molecular weight (Mn): 536) was used as the release agent instead of 20 parts of behenyl stearate, and evaluation was performed in the same manner. The results are shown in Table 3.

Example 1-3

A color resin particle and a toner for electrostatic-image development of Example 1-3 were obtained in the same manner as in Example 1-1, except that 20 parts of behenyl behenate (number average molecular weight (Mn): 648) was used as the release agent instead of 20 parts of behenyl stearate, and evaluation was performed in the same manner. The results are shown in Table 3.

Example 1-4

A color resin particle and a toner for electrostatic-image development of Example 1-4 were obtained in the same manner as in Example 1-1, except that 1.7 parts of solution polymerized polyisoprene rubber 1 (trade name "Kuraprene LIR-30", manufactured by Kuraray Co., Ltd., weight average molecular weight (Mw): 28,000, solubility in styrene at a temperature of 40° C.: 16 g/100 g) was used as the additive having the polydiene structure instead of 5 parts of the block copolymer composition (α1) obtained in Production Example 1, and evaluation was performed in the same manner. The results are shown in Table 3.

Example 1-5

A color resin particle and a toner for electrostatic-image development of Example 1-5 were obtained in the same manner as in Example 1-1, except that the amount of the block copolymer composition (α1), as the additive having the polydiene structure, was changed from 5 parts to 2 parts, and evaluation was performed in the same manner. The results are shown in Table 3.

Example 1-6

A color resin particle and a toner for electrostatic-image development of Example 1-6 were obtained in the same manner as in Example 1-1, except that the amount of the block copolymer composition (α1), as the additive having the polydiene structure, was changed from 5 parts to 10 parts, and evaluation was performed in the same manner. The results are shown in Table 3.

Comparative Example 1-1

A color resin particle and a toner for electrostatic-image development of Comparative Example 1-1 were obtained in the same manner as in Example 1-1, except that the block copolymer composition (α1) was not blended as the additive having the polydiene structure, and evaluation was performed in the same manner. The results are shown in Table 3.

Comparative Example 1-2

A color resin particle and a toner for electrostatic-image development of Comparative Example 1-2 were obtained in the same manner as in Comparative Example 1-1, except that 20 parts of behenyl behenate (number average molecular weight (Mn): 648) was used instead of 20 parts of behenyl stearate as the release agent, and evaluation was performed in the same manner. The results are shown in Table 3.

Comparative Example 1-3

A color resin particle and a toner for electrostatic-image development of Comparative Example 1-3 were obtained in the same manner as in Example 1-1, except that 1.7 parts of solution polymerized polyisoprene rubber 2 (trade name "IR2200", manufactured by Zeon Corporation, weight average molecular weight (Mw): 1,100,000, solubility in styrene at a temperature of 40° C.: 2.4 g/100 g) was used as the additive having the polydiene structure instead of 5 parts of the block copolymer composition (α1) obtained in Production Example 1, and evaluation was performed in the same manner. The results are shown in Table 3.

[Evaluation of Examples 1-1 to 1-6 and Comparative Examples 1-1 to 1-3]

As shown in Table 3, the toners in Examples 1-1 to 1-6, which were obtained by using the specific color resin particle had high storage stability, low minimum fixing temperature, and were excellent low-temperature fixing property, the specific color resin particle comprising the binder resin, the colorant, the charge control agent, and the release agent, and the additive having the polydiene structure with the solubility in styrene at a temperature of 40° C. of 3 to 40 g/100 g, having the number of crystal domains of the release agent which had the aspect ratio in a range of 2 to 10 in a field of view of 2 μm×2 μm square of the cross section by the observation using the transmission electron microscope (TEM) of 2 to 30, and having the storage modulus G'(60) of at 60° C. of $1.6\times10^8$ to $5.0\times10^8$ Pa. Further, Examples 1-1 to 1-6 were also high in the hot offset occurring temperature, were excellent in hot offset resistance.

On the other hand, the toners of Comparative Examples 1-1 to 1-3 obtained using the color resin particle not containing the additive having the polydiene structure with the solubility in styrene at a temperature of 40° C. of 3 to 40 g/100 g, and having the number of crystal domains of the

TABLE 3

| | | | Example | | | | | | Comparative Example | | |
|---|---|---|---|---|---|---|---|---|---|---|---|
| | | | 1-1 | 1-2 | 1-3 | 1-4 | 1-5 | 1-6 | 1-1 | 1-2 | 1-3 |
| Polymerizable monomer | Styrene | (parts) | 77 | 77 | 77 | 77 | 77 | 77 | 77 | 77 | 77 |
| | n-butyl acrylate | (parts) | 23 | 23 | 23 | 23 | 23 | 23 | 23 | 23 | 23 |
| | Divinylbenzene | (parts) | 0.6 | 0.6 | 0.6 | 0.6 | 0.6 | 0.6 | 0.6 | 0.6 | 0.6 |
| Release agent | Behenyl stearate | (parts) | 20 | — | — | 20 | 20 | 20 | 20 | — | 20 |
| | Stearyl stearate | (parts) | — | 20 | — | — | — | — | — | — | — |
| | Behenyl behenate | (parts) | — | — | 20 | — | — | — | — | 20 | — |
| Polar resin | Methyl methacrylate-ethyl acrylate-acrylic acid copolymer | (parts) | 1 | 1 | 1 | 1 | 1 | 1 | 1 | 1 | 1 |
| Additive having polydiene structure | Block copolymer composition (α1)*1) | (parts) | 5 | 5 | 5 | — | 2 | 10 | — | — | — |
| | Solution polymerized polyisoprene rubber 1 | (parts) | — | — | — | 1.7 | — | — | — | — | — |
| | Solution polymerized polyisoprene rubber 2 | (parts) | — | — | — | — | — | — | — | — | 2.0 |
| Volume average particle diameter (Dv) of color resin particle | | (μm) | 7.3 | 8.0 | 8.1 | 8.5 | 7.0 | 7.4 | 7.0 | 8.5 | 7.3 |
| Average aspect ratio of crystal domains of release agent in color resin particle | | | 4.3 | 4.6 | 4.4 | 2.1 | 8.0 | 3.8 | 1.1 | 1.1 | 1.2 |
| Average major axis of crystal domains of release agent in color resin particle | | (μm) | 0.30 | 0.32 | 0.31 | 0.17 | 0.80 | 0.22 | 2.5 | 2.5 | 2.6 |
| Average minor axis of crystal domains of release agent in color resin particle | | (μm) | 0.07 | 0.07 | 0.07 | 0.08 | 0.10 | 0.04 | 2.2 | 2.2 | 2.2 |
| Number of crystal domains of release agent having aspect ratio in range of 2 to 10 in field of view of 2 μm × 2 μm square of color resin particle | | | 18 | 20 | 15 | 10 | 4 | 27 | 0 | 0 | 0 |
| Number of crystal domains of release agent having aspect ratio in range of 3 to 8 in field of view of 2 μm × 2 μm square of color resin particle | | | 18 | 19 | 14 | 10 | 3 | 20 | 0 | 0 | 0 |
| Storage modulus G'(60) of the color resin particle at 60° C. | | (Pa) | $2.2\times10^8$ | $2.1\times10^8$ | $3.4\times10^8$ | $3.4\times10^8$ | $2.5\times10^8$ | $4.4\times10^8$ | $5.0\times10^7$ | $8.0\times10^7$ | $6.2\times10^7$ |
| Storage modulus G'(100) of the color resin particle at 100° C. | | (Pa) | $1.4\times10^5$ | $1.2\times10^5$ | $1.4\times10^5$ | $1.5\times10^5$ | $1.4\times10^5$ | $1.5\times10^5$ | $1.8\times10^5$ | $2.0\times10^5$ | $2.3\times10^5$ |
| G'(60)/G'(100) | | | $1.6\times10^3$ | $1.8\times10^3$ | $2.4\times10^3$ | $2.4\times10^3$ | $1.8\times10^3$ | $2.9\times10^3$ | $2.8\times10^2$ | $4.0\times10^2$ | $2.7\times10^2$ |
| Storage temperature of toner | | (° C.) | 60 | 60 | 60 | 60 | 60 | 59 | 57 | 57 | 57 |
| Minimum fixing temperature of toner | | (° C.) | 120 | 120 | 120 | 120 | 125 | 120 | 130 | 135 | 135 |
| Hot offset occurring temperature of toner | | (° C.) | 230 | 230 | 230 | 230 | 230 | 225 | 210 | 210 | 210 |

*1)The block copolymer composition (α1) is a composition containing a styrene-isoprene diblock copolymer and a styrene-isoprene-styrene triblock copolymer.

release agent which had the aspect ratio in a range of 2 to 10 of less than 2, were low in storage temperature and inferior storage stability.

Note that, FIG. 1(A) is a cross-sectional photograph of the color resin particle by the transmission electron microscope (TEM) of Example 1-1, and FIG. 1(B) is a cross-sectional photograph of the color resin particle by the transmission electron microscope (TEM) of Comparative Example 1-1. As shown in FIG. 1(A), according to Examples 1-1 to 1-6, the crystal domains of the release agent having the aspect ratio in the range of 2 to 10 were finely dispersed in the color resin particle (the same applies to Examples 2-1 to 2-2, 3-1 to 3-7, and 4-1 to 4-4, which will be described later). On the other hand, as shown in FIG. 1(B), in Comparative Examples 1-1 to 1-3, the release agent localized in the vicinity of the center of the color resin particle (in the vicinity of the position slightly lower left from the center) to form a large domain structure.

Example 2-1

A color resin particle and a toner for electrostatic-image development of Example 2-1 were obtained in the same manner as in Example 1-1, except that the amount of divinylbenzene was changed from 0.6 parts to 0.3 parts, and evaluation was performed in the same manner. The results are shown in Table 4.

Example 2-2

A color resin particle and a toner for electrostatic-image development of Example 2-2 were obtained in the same manner as in Example 2-1, except that the amount of divinylbenzene was changed from 0.3 parts to 0.33 parts, and evaluation was performed in the same manner. The results are shown in Table 4.

Comparative Example 2-1

A color resin particle and a toner for electrostatic-image development of Comparative Example 2-1 were obtained in the same manner as in Example 2-1, except that the amount of divinylbenzene was changed from 0.3 parts to 0.51 parts and the block copolymer composition (α1) was not blended as the additive having the polydiene structure, and evaluation was performed in the same manner. The results are shown in Table 4.

Comparative Example 2-2

A color resin particle and a toner for electrostatic-image development of Comparative Example 2-2 were obtained in the same manner as in Example 2-1, except that the amount of divinylbenzene was changed from 0.3 parts to 0.54 parts and the block copolymer composition (α1) was not blended as the additive having the polydiene structure, and evaluation was performed in the same manner. The results are shown in Table 4.

Comparative Example 2-3

A color resin particle and a toner for electrostatic-image development of Comparative Example 2-3 were obtained in the same manner as in Example 2-1, except that the amount of divinylbenzene was changed from 0.3 parts to 0.6 parts and 5 parts of styrene-ethylene/propylene-styrene block copolymer (manufactured by Kuraray Co., Ltd., trade name: Septon 2104, styrene unit content: 65% by mass, weight average molecular weight (Mw): 64,000, solubility in styrene at a temperature of 40° C.: 15 g/100 g) was used instead of 5 parts of the block copolymer composition (α1) as the additive having the polydiene structure, and evaluation was performed in the same manner. The results are shown in Table 4.

Comparative Example 2-4

A color resin particle and a toner for electrostatic-image development of Comparative Example 2-4 were obtained in the same manner as in Example 2-1, except that the amount of divinylbenzene was changed from 0.3 parts to 0.6 parts and 5 parts of styrene-ethylene/propylene-styrene block copolymer (manufactured by Kuraray Co., Ltd., trade name: Septon 4033, styrene unit content: 30% by mass, weight average molecular weight (Mw): 81,000, solubility in styrene at a temperature of 40° C.: 15 g/100 g) was used instead of 5 parts of the block copolymer composition (α1) as the additive having the polydiene structure, and evaluation was performed in the same manner. The results are shown in Table 4.

TABLE 4

| | | | Example | | Comparative Example | | | |
|---|---|---|---|---|---|---|---|---|
| | | | 2-1 | 2-2 | 2-1 | 2-2 | 2-3 | 2-4 |
| Polymerizable monomer | Styrene | (parts) | 77 | 77 | 77 | 77 | 77 | 77 |
| | n-butyl acrylate | (parts) | 23 | 23 | 23 | 23 | 23 | 23 |
| | Divinylbenzene | (parts) | 0.3 | 0.33 | 0.51 | 0.54 | 0.6 | 0.6 |
| Release agent | Behenyl stearate | (parts) | 20 | 20 | 20 | 20 | 20 | 20 |
| Polar resin | Methyl methacrylate-ethyl acrylate-acrylic acid copolymer | (parts) | 1 | 1 | 1 | 1 | 1 | 1 |
| Additive having polydiene structure | Block copolymer composition (α1)*1) | (parts) | 5 | 5 | — | — | — | — |
| | Styrene-ethylene/propylene-styrene block copolymer (Septon 2104) | (parts) | — | — | — | — | 5 | — |
| | Styrene-ethylene/propylene-styrene block copolymer (Septon 4033) | (parts) | — | — | — | — | — | 5 |
| Volume average particle diameter (Dv) of color resin particle | | (μm) | 6.6 | 6.8 | 7.2 | 7.5 | 8.3 | 7.5 |
| Melting temperature (T1/2) of color resin particle | | (° C.) | 128.0 | 136.0 | 128.0 | 135.0 | — | — |

TABLE 4-continued

| | | Example | | Comparative Example | | | |
|---|---|---|---|---|---|---|---|
| | | 2-1 | 2-2 | 2-1 | 2-2 | 2-3 | 2-4 |
| Number of crystal domains of release agent having aspect ratio in range of 2 to 10 in field of view of 2 μm × 2 μm square of color resin particle | | 15 | 12 | 0 | 0 | 0 | 0 |
| Number of crystal domains of release agent having aspect ratio in range of 3 to 8 in field of view of 2 μm × 2 μm square of color resin particle | | 15 | 11 | 0 | 0 | 0 | 0 |
| Storage modulus G'(60) of the color resin particle at 60° C. | (Pa) | $2.6 \times 10^8$ | $2.4 \times 10^8$ | $5.0 \times 10^7$ | $3.2 \times 10^7$ | $1.5 \times 10^8$ | $1.2 \times 10^8$ |
| Storage modulus G'(100) of the color resin particle at 100° C. | (Pa) | $1.3 \times 10^5$ | $1.7 \times 10^5$ | $1.0 \times 10^5$ | $1.0 \times 10^5$ | $2.0 \times 10^5$ | $1.9 \times 10^5$ |
| G'(60)/G'(100) | | $2.0 \times 10^3$ | $1.4 \times 10^3$ | $5.0 \times 10^2$ | $3.2 \times 10^2$ | $7.5 \times 10^2$ | $6.3 \times 10^2$ |
| Storage temperature of toner | (° C.) | 59 | 59 | 57 | 57 | 58 | 58 |
| Minimum fixing temperature of toner | (° C.) | 125 | 125 | 125 | 125 | 130 | 125 |

*1)The block copolymer composition (α1) is a composition containing a styrene-isoprene diblock copolymer and a styrene-isoprene-styrene triblock copolymer.

[Evaluation of Examples 2-1 to 2-2 and Comparative Examples 2-1 to 2-4]

As shown in Table 4, the toners in Examples 2-1 to 2-2, which were obtained by using the specific color resin particle had high storage stability, low minimum fixing temperature, and were excellent low-temperature fixing property, the specific color resin particle comprising the binder resin, the colorant, the charge control agent, and the release agent, and the additive having the polydiene structure with the solubility in styrene at a temperature of 40° C. of 3 to 40 g/100 g, having the number of crystal domains of the release agent which had the aspect ratio in a range of 2 to 10 in a field of view of 2 μm×2 μm square of the cross section by the observation using the transmission electron microscope (TEM) of 2 to 30, and having the storage modulus G'(60) of at 60° C. of $1.6\times10^8$ to $5.0\times10^8$ Pa.

On the other hand, the toners of comparative examples 2-1 to 2-4 obtained by using color resin particle having storage modulus G'(60) of at 60° C. of less than $1.6\times10^8$ Pa, were low in storage temperature and inferior storage stability.

Example 3-1

A color resin particle and a toner for electrostatic-image development of Example 3-1 were obtained in the same manner as in Example 1-1, except that the amount of divinylbenzene was changed from 0.6 parts to 0.45 parts, and evaluation was performed in the same manner. The results are shown in Table 5.

Example 3-2

A color resin particle and a toner for electrostatic-image development of Example 3-2 were obtained in the same manner as in Example 1-1, except that the amount of divinylbenzene was changed from 0.6 parts to 0.3 parts, and evaluation was performed in the same manner. The results are shown in Table 5.

Example 3-3

A color resin particle and a toner for electrostatic-image development of Example 3-3 were obtained in the same manner as in Example 3-1, except that the amount of divinylbenzene was changed from 0.45 parts to 0.6 parts and the amount of the block copolymer composition (α1) obtained in Production Example 1 was changed from 5 parts to 2 parts, and evaluation was performed in the same manner. The results are shown in Table 5.

Example 3-4

A color resin particle and a toner for electrostatic-image development of Example 3-4 were obtained in the same manner as in Example 3-3, except that the amount of divinylbenzene was changed from 0.6 parts to 0.5 parts, and evaluation was performed in the same manner. The results are shown in Table 5.

Example 3-5

A color resin particle and a toner for electrostatic-image development of Example 3-5 were obtained in the same manner as in Example 3-3, except that the amount of divinylbenzene was changed from 0.6 parts to 0.4 parts, and evaluation was performed in the same manner. The results are shown in Table 5.

Example 3-6

A color resin particle and a toner for electrostatic-image development of Example 3-6 were obtained in the same manner as in Example 3-1, except that the amount of styrene was changed from 77 parts to 83 parts, the amount of n-butyl acrylate was changed from 23 parts to 17 parts, and the amount of divinylbenzene was changed from 0.45 parts to 0.6 parts, and evaluation was performed in the same manner. The results are shown in Table 5.

Example 3-7

A color resin particle and a toner for electrostatic-image development of Example 3-7 were obtained in the same manner as in Example 3-3, except that the acrylic resin obtained in Production Example 6 was not blended, and evaluation was performed in the same manner. The results are shown in Table 5.

Comparative Example 3-1

A color resin particle and a toner for electrostatic-image development of Comparative Example 3-1 were obtained in the same manner as in Example 3-3, except that the block copolymer composition (α1) was not blended obtained in Production Example 1, and evaluation was performed in the same manner. The results are shown in Table 5.

Comparative Example 3-2

A color resin particle and a toner for electrostatic-image development of Comparative Example 3-2 were obtained in the same manner as in Example 3-3, except that 2 parts of styrene-ethylene/propylene-styrene block copolymer (manufactured by Kuraray Co., Ltd., trade name: Septon 2063, styrene unit content: 13% by mass, weight average molecular weight (Mw): 91000, solubility in styrene at a temperature of 40° C.: 15 g/100 g) was used instead of 2 parts of the block copolymer composition (α1) obtained in Production Example 1, and evaluation was performed in the same manner. The results are shown in Table 5.

Comparative Example 3-3

A color resin particle and a toner for electrostatic-image development of Comparative Example 3-3 were obtained in the same manner as in Example 3-3, except that 5 parts of styrene-ethylene/propylene-styrene block copolymer (manufactured by Kuraray Co., Ltd., trade name: Septon 2063) was used instead of 2 parts of the block copolymer composition (α1) obtained in Production Example 1, and evaluation was performed in the same manner. The results are shown in Table 5.

Comparative Example 3-4

A color resin particle and a toner for electrostatic-image development of Comparative Example 3-4 were obtained in the same manner as in Example 3-3, except that 2 parts of styrene-ethylene/propylene-styrene block copolymer (manufactured by Kuraray Co., Ltd., trade name: Septon 2100) was used instead of 2 parts of the block copolymer composition (α1) obtained in Production Example 1, and evaluation was performed in the same manner. The results are shown in Table 5.

Comparative Example 3-5

A color resin particle and a toner for electrostatic-image development of Comparative Example 3-5 were obtained in the same manner as in Example 3-3, except that 2 parts of styrene-ethylene/propylene-styrene block copolymer (manufactured by Kuraray Co., Ltd., trade name: Septon 4033) was used instead of 2 parts of the block copolymer composition (α1) obtained in Production Example 1, and evaluation was performed in the same manner. The results are shown in Table 5.

TABLE 5

| | | | Example | | | | | | |
|---|---|---|---|---|---|---|---|---|---|
| | | | 3-1 | 3-2 | 3-3 | 3-4 | 3-5 | 3-6 | 3-7 |
| Polymerizable monomer | Styrene | (parts) | 77 | 77 | 77 | 77 | 77 | 83 | 77 |
| | n-butyl acrylate | (parts) | 23 | 23 | 23 | 23 | 23 | 17 | 23 |
| | Divinylbenzene | (parts) | 0.45 | 0.3 | 0.6 | 0.5 | 0.4 | 0.6 | 0.6 |
| Release agent | Behenyl stearate | (parts) | 20 | 20 | 20 | 20 | 20 | 20 | 20 |
| Polar resin | Methyl meth-acrylate-ethyl acrylate-acrylic acid copolymer | (parts) | 1 | 1 | 1 | 1 | 1 | 1 | — |
| Additive having polydiene structure | Block copolymer composition (α1)*1) | (parts) | 5 | 5 | 2 | 2 | 2 | 2 | 5 |
| | Styrene-ethylene/propylene-styrene block copolymer (Septon 2063) | (parts) | — | — | — | — | — | — | — |
| | Styrene-ethylene/propylene-styrene block copolymer (Septon 2104) | (parts) | — | — | — | — | — | — | — |
| | Styrene-ethylene/propylene-styrene block copolymer (Septon 4033) | (parts) | — | — | — | — | — | — | — |
| Volume average particle diameter (Dv) of color resin particle | | (μm) | 6.6 | 6.4 | 7.1 | 7.5 | 7.1 | 7.2 | 7.2 |
| Gel content of color resin particle | | (wt %) | 46 | 3 | 22 | 13 | 2 | 44 | 39 |
| Weight average molecular weight (Mw) of color resin particle | | | 89,800 | 166,800 | 45,000 | 35,700 | 177,900 | 44,620 | 45,510 |
| Melting temperature (T1/2) of color resin particle | | (° C.) | 150.9 | 128.1 | 165.5 | 154.1 | 130.4 | 164.4 | 162.2 |
| Number of crystal domains of release agent having aspect ratio in range of 2 to 10 in field of view of 2 μm × 2 μm square of color resin particle | | | 16 | 22 | 19 | 19 | 17 | 14 | 16 |
| Number of crystal domains of release agent having aspect ratio in range of 3 to 8 in field of view of 2 μm × 2 μm square of color resin particle | | | 16 | 20 | 19 | 19 | 16 | 12 | 16 |
| Storage modulus G'(60) of the color resin particle at 60° C. | | (Pa) | $2.3 \times 10^8$ | $2.3 \times 10^8$ | $3.6 \times 10^8$ | $3.3 \times 10^8$ | $3.3 \times 10^8$ | $4.1 \times 10^8$ | $2.5 \times 10^8$ |
| Storage modulus G'(100) of the | | (Pa) | 1.8 × | 1.4 × | 2.0 × | 2.2 × | 2.2 × | 2.3 × | 2.5 × |

TABLE 5-continued

| | | | | | | | | |
|---|---|---|---|---|---|---|---|---|
| color resin particle at 100° C. | | $10^5$ | $10^5$ | $10^5$ | $10^5$ | $10^5$ | $10^5$ | $10^5$ |
| G'(60)/G'(100) | | $1.3 \times 10^3$ | $1.6 \times 10^3$ | $1.8 \times 10^3$ | $1.5 \times 10^3$ | $1.5 \times 10^3$ | $1.8 \times 10^3$ | $1.0 \times 10^3$ |
| Storage temperature of toner | (° C.) | 58 | 58 | 60 | 59 | 59 | 62 | 58 |
| Minimum fixing temperature of toner | (° C.) | 125 | 115 | 125 | 125 | 125 | 130 | 130 |

| | | | Comparative Example | | | | |
|---|---|---|---|---|---|---|---|
| | | | 3-1 | 3-2 | 3-3 | 3-4 | 3-5 |
| Poly-merizable monomer | Styrene | (parts) | 77 | 77 | 77 | 77 | 77 |
| | n-butyl acrylate | (parts) | 23 | 23 | 23 | 23 | 23 |
| | Divinylbenzene | (parts) | 0.6 | 0.6 | 0.6 | 0.6 | 0.6 |
| Release agent | Behenyl stearate | (parts) | 20 | 20 | 20 | 20 | 20 |
| Polar resin | Methyl meth-acrylate-ethyl acrylate-acrylic acid copolymer | (parts) | 1 | 1 | 1 | 1 | 1 |
| Additive having polydiene structure | Block copolymer composition (α1)*1) | (parts) | — | — | — | — | — |
| | Styrene-ethylene/propylene-styrene block copolymer (Septon 2063) | (parts) | — | 2 | 5 | — | — |
| | Styrene-ethylene/propylene-styrene block copolymer (Septon 2104) | (parts) | — | — | — | 2 | — |
| | Styrene-ethylene/propylene-styrene block copolymer (Septon 4033) | (parts) | — | — | — | — | 2 |
| Volume average particle diameter (Dv) of color resin particle | | (μm) | 7.2 | 7.3 | 8.3 | 7.3 | 7.6 |
| Gel content of color resin particle | | (wt %) | 46 | 40 | 45 | 39 | 45 |
| Weight average molecular weight (Mw) of color resin particle | | | 56,120 | 47,750 | 49,080 | 44,360 | 45,450 |
| Melting temperature (T1/2) of color resin particle | | (° C.) | 132.5 | 145.6 | 160.4 | 149.5 | 143.8 |
| Number of crystal domains of release agent having aspect ratio in range of 2 to 10 in field of view of 2 μm × 2 μm square of color resin particle | | | 0 | 0 | 0 | 0 | 0 |
| Number of crystal domains of release agent having aspect ratio in range of 3 to 8 in field of view of 2 μm × 2 μm square of color resin particle | | | 0 | 0 | 0 | 0 | 0 |
| Storage modulus G'(60) of the color resin particle at 60° C. | | (Pa) | $4.4 \times 10^7$ | $4.8 \times 10^7$ | $4.4 \times 10^7$ | $5.7 \times 10^7$ | $7.2 \times 10^7$ |
| Storage modulus G'(100) of the color resin particle at 100° C. | | (Pa) | $2.4 \times 10^5$ | $2.4 \times 10^5$ | $2.4 \times 10^5$ | $2.5 \times 10^5$ | $2.6 \times 10^5$ |
| G'(60)/G'(100) | | | $1.8 \times 10^2$ | $2.0 \times 10^2$ | $1.8 \times 10^2$ | $2.3 \times 10^2$ | $2.8 \times 10^2$ |
| Storage temperature of toner | | (° C.) | 56 | 56 | 55 | 56 | 56 |
| Minimum fixing temperature of toner | | (° C.) | 130 | 130 | 130 | 130 | 130 |

*1)The block copolymer composition (α1) is a composition containing a styrene-isoprene diblock copolymer and a styrene-isoprene-styrene triblock copolymer.

[Evaluation of Examples 3-1 to 3-7 and Comparative Examples 3-1 to 3-5]

As shown in Table 5, the toners in Examples 3-1 to 3-7, which were obtained by using the specific color resin particle had high storage stability, low minimum fixing temperature, and were excellent low-temperature fixing property, the specific color resin particle comprising the binder resin, the colorant, the charge control agent, and the release agent, and the additive having the polydiene structure with the solubility in styrene at a temperature of 40° C. of 3 to 40 g/100 g, having the number of crystal domains of the release agent which had the aspect ratio in a range of 2 to 10 in a field of view of 2 μm×2 μm square of the cross section by the observation using the transmission electron microscope (TEM) of 2 to 30, and having the storage modulus G'(60) of at 60° C. of $1.6\times10^8$ to $5.0\times10^8$ Pa.

On the other hand, the toners of Comparative Examples 3-1 to 3-5, where the additive having the polydiene structure was not blended or the aromatic vinyl-based thermoplastic elastomer not having the polydiene structure and not having an unsaturated bond capable of a polymerization reaction was used, were low in storage temperature and inferior storage stability. Further, in the toners of Comparative Examples 3-1 to 3-5, the existence state of behenyl stearate as the release agent in the cross section of the toner was confirmed by SEM and TEM, and it was confirmed that behenyl stearate was localized in the vicinity of the center of the toner particle to form a large domain structure.

Example 4-1

70.5 parts of styrene and 29.5 parts of n-butyl acrylate as a monovinyl monomer, 7 parts of carbon black (trade name: #25B, manufactured by Mitsubishi Chemical Corporation) as a colorant, 0.6 parts of divinylbenzene as a cross-linkable polymerizable monomer, 1.2 parts of t-dodecylmercaptan as a molecular weight adjusting agent, 0.3 parts of polymethacrylic ester macromonomer (trade name: AA6, Tg=94° C., manufactured by Toagosei Company, Limited) as a macromonomer, and 1 part of the acrylic resin obtained in Production Example 6 was subjected to wet grinding using a media type wet grinder, and then 1 part of a charge control resin (styrene/acrylic resin containing a quaternary ammonium salt as a functional group, copolymerization ratio of monomers containing a functional group of a quaternary ammonium salt of 2%) as a charge control agent, 20 parts of behenyl stearate (number average molecular weight (Mn): 592) as a release agent, and 5 parts of the block copolymer composition (α2) obtained in Production Example 2 as an additive having a polydiene structure were added and mixing to obtain a polymerizable monomer composition.

Then, a color resin particle and a toner for electrostatic-image development of Example 4-1 were obtained in the same manner as in Example 1-1, except that the polymerizable monomer composition obtained above was used, and evaluation was performed in the same manner. The results are shown in Table 6.

Example 4-2

A color resin particle and a toner for electrostatic-image development of Example 4-2 were obtained in the same manner as in Example 4-1, except that 5 parts of the block copolymer composition (α1) obtained in Production Example 1 was used instead of 5 parts of the block copolymer composition (α2) obtained in Production Example 2, and evaluation was performed in the same manner. The results are shown in Table 6.

Example 4-3

A color resin particle and a toner for electrostatic-image development of Example 4-3 were obtained in the same manner as in Example 4-1, except that 5 parts of the block copolymer composition (α3) obtained in Production Example 3 was used instead of 5 parts of the block copolymer composition (α2) obtained in Production Example 2, and evaluation was performed in the same manner. The results are shown in Table 6.

Example 4-4

A color resin particle and a toner for electrostatic-image development of Example 4-4 were obtained in the same manner as in Example 4-1, except that 5 parts of the block copolymer composition (α1) obtained in Production Example 1 was used instead of 5 parts of the block copolymer composition (α2) obtained in Production Example 2 and the acrylic resin obtained in Production Example 6 was not blended, and evaluation was performed in the same manner. The results are shown in Table 6.

Comparative Example 4-1

A color resin particle and a toner for electrostatic-image development of Comparative Example 4-1 were obtained in the same manner as in Example 4-1, except that the block copolymer composition (α2) obtained in Production Example 2 was not blended, and evaluation was performed in the same manner. The results are shown in Table 6.

Comparative Example 4-2

A color resin particle and a toner for electrostatic-image development of Comparative Example 4-2 were obtained in the same manner as in Example 4-1, except that 5 parts of the block copolymer composition (α4) obtained in Production Example 4 was used instead of 5 parts of the block copolymer composition (α2) obtained in Production Example 2, and evaluation was performed in the same manner. The results are shown in Table 6.

Comparative Example 4-3

A color resin particle and a toner for electrostatic-image development of Comparative Example 4-3 were obtained in the same manner as in Example 4-1, except that 5 parts of the block copolymer composition (α5) obtained in Production Example 5 was used instead of 5 parts of the block copolymer composition (α2) obtained in Production Example 2, and evaluation was performed in the same manner. The results are shown in Table 6.

TABLE 6

| | | Example | | | | Comparative Example | | |
|---|---|---|---|---|---|---|---|---|
| | | 4-1 | 4-2 | 4-3 | 4-4 | 4-1 | 4-2 | 4-3 |
| Polar resin (acrylic resin) | Amount of methyl methacrylate-ethyl acrylate-acrylic acid copolymer [parts] | 1 | 1 | 1 | 0 | 1 | 1 | 1 |
| Aromatic vinyl-based thermoplastic elastomer | Type | (α2) | (α1) | (α3) | (α1) | — | (α4) | (α5) |
| | Styrene unit content [%] | 18 | 22 | 16.5 | 22 | — | 15.5 | 16 |
| | Content ratio of styrene-isoprene diblock copolymer B [%] | 56 | 70 | 78 | 70 | — | 26 | — |
| | Content ratios of three-branched and four-branched styrene-isoprene block copolymer C, D [%] | — | — | — | — | — | — | 30 |
| | Weight average molecular weight | 166,000 | 142,000 | 188,000 | 142,000 | — | 192,000 | 192,000 |
| | Addition amount [parts] | 5 | 5 | 5 | 5 | — | 5 | 5 |
| Volume average particle diameter (Dv) of color resin particle | | 8.5 | 7.9 | 7.9 | 8.0 | 7.3 | 9.0 | 8.2 |
| Number of crystal domains of release agent having aspect ratio in range of 2 to 10 in | | 20 | 14 | 12 | 15 | 0 | 0 | 0 |

TABLE 6-continued

| | Example | | | | Comparative Example | | |
|---|---|---|---|---|---|---|---|
| | 4-1 | 4-2 | 4-3 | 4-4 | 4-1 | 4-2 | 4-3 |
| field of view of 2 μm × 2 μm square of color resin particle | | | | | | | |
| Number of crystal domains of release agent having aspect ratio in range of 3 to 8 in field of view of 2 μm × 2 μm in square of color resin particle | 17 | 14 | 12 | 14 | 0 | 0 | 0 |
| Storage modulus G'(60) of the color resin particle at 60° C. [Pa] | $2.2 \times 10^8$ | $2.5 \times 10^8$ | $2.2 \times 10^8$ | $2.2 \times 10^8$ | $4.3 \times 10^7$ | $7.9 \times 10^7$ | $8.4 \times 10^7$ |
| Storage modulus G'(100) of the color resin particle at 100° C. [Pa] | $1.7 \times 10^5$ | $1.4 \times 10^5$ | $1.6 \times 10^5$ | $2.2 \times 10^5$ | $2.8 \times 10^5$ | $2.7 \times 10^5$ | $2.5 \times 10^5$ |
| G'(60)/G'(100) | $1.3 \times 10^3$ | $1.8 \times 10^3$ | $1.4 \times 10^3$ | $1.0 \times 10^3$ | $1.5 \times 10^2$ | $2.9 \times 10^2$ | $3.4 \times 10^2$ |
| Charge amount of toner | 1.39 | 0.95 | 2.46 | 2.29 | 0.57 | −1.19 | 0.67 |
| Bleeding rate of toner at 40° C. after 30 days [%] | 8.3 | 2.3 | 3.8 | 10.1 | 18 | 3.6 | 4.2 |
| Evaluation of jetting of toner | No jetting even after 6 hours | No jetting even after 6 hours | No jetting even after 6 hours | No jetting even after 6 hours | Jetting occurred after 1 hour | Jetting occurred after 3 hours | Jetting occurred after 3 hours |
| Sticking material to blade of toner | None | None | None | None | Present | Present | Present |
| Storage temperature of toner [° C.] | 58 | 58 | 58 | 58 | 56 | 57 | 57 |
| Minimum fixing temperature of toner [° C.] | 125 | 125 | 125 | 130 | 130 | 130 | 130 |

As shown in Table 6, the toners of Examples 4-1 to 4-4 obtained using those further containing an aromatic vinyl-based thermoplastic elastomer containing a diblock copolymer composed of an aromatic vinyl polymer block and a block of a polymer copolymerizable and having a ratio of an aromatic vinyl polymer of 40% by weight or more, as the additive having the polydiene structure had high storage temperature, were excellent storage stability, low minimum fixing temperature, and excellent low-temperature fixing property. In addition, it was confirmed that the charging property was high, the bleed-out of the release agent was suppressed, and the occurrence of jetting and sticking to the blade under high-temperature and high-humidity conditions was effectively suppressed.

On the other hand, the toners of Comparative Examples 4-1 to 4-3, where a diblock copolymer composed of an aromatic vinyl polymer block and a block of a polymer copolymerizable with an aromatic vinyl polymer was not contained or an aromatic vinyl-based thermoplastic elastomer having a ratio of an aromatic vinyl polymer of less than 40% by weight was used, resulted in occurrence of jetting and sticking to a blade under high temperature and high humidity conditions.

The invention claimed is:

1. A toner for electrostatic-image development comprising a color resin particle containing a binder resin, a colorant, a charge control agent, and a release agent, and an additive having a polydiene structure, wherein the additive having the polydiene structure has a solubility in styrene at a temperature of 40° C. of 3 to 40 g/100 g, the additive having a polydiene structure is a conjugated diene-aromatic vinyl-based thermoplastic elastomer, the conjugated diene-aromatic vinyl-based thermoplastic elastomer contains a diblock copolymer composed of an aromatic vinyl polymer block and a block of a polymer copolymerizable with an aromatic vinyl polymer, a content ratio of the diblock copolymer in the conjugated diene-aromatic vinyl-based thermoplastic elastomer is 40% by mass or more, and when a cross section of the color resin particle is observed by a transmission electron microscope (TEM), the number of crystal domains of the release agent having an aspect ratio in a range of 2 to 10 in a field of view of 2 μm x 2 μm square of the cross section of the color resin particle is 2 to 30.

2. A toner for electrostatic-image development comprising a color resin particle containing a binder resin, a colorant, a charge control agent, and a release agent, and an additive having a polydiene structure, wherein the additive having the polydiene structure has a solubility in styrene at a temperature of 40° C. of 3 to 40 g/100 g, the additive having a polydiene structure is a conjugated diene-aromatic vinyl-based thermoplastic elastomer, the conjugated diene-aromatic vinyl-based thermoplastic elastomer contains a diblock copolymer composed of an aromatic vinyl polymer block and a block of a polymer copolymerizable with an aromatic vinyl polymer, a content ratio of the diblock copolymer in the conjugated diene-aromatic vinyl-based thermoplastic elastomer is 40% by mass or more, and a storage modulus G'(60) of the color resin particle at 60° C., which is determined by dynamic viscoelasticity measurement, is $1.6\times10^8$ to $5.0\times10^8$ Pa.

3. The toner for electrostatic-image development according to claim 1, wherein a storage modulus G'(60) of the color resin particle at 60° C., which is determined by dynamic viscoelasticity measurement, is $1.6\times10^8$ to $5.0\times10^8$ Pa.

4. The toner for electrostatic-image development according to claim 3, wherein a storage modulus G'(100) of the color resin particle at 100° C., which is determined by dynamic viscoelasticity measurement, is $1.0\times10^5$ to $3.0\times10^5$ Pa.

5. The toner for electrostatic-image development according to claim 3, wherein a ratio G'(60)/G'(100) of the storage modulus G'(60) at 60° C. to a storage modulus G'(100) at 100° C., which is determined by dynamic viscoelasticity measurement, is $1.0\times10^3$ to $5.0\times10^3$.

6. The toner for electrostatic-image development according to claim 1, wherein a content ratio of the aromatic vinyl monomer unit in the conjugated diene-aromatic vinyl-based thermoplastic elastomer is 10 to 30% by mass with respect to the total monomer unit.

7. The toner for electrostatic-image development according to claim 1, wherein a content of the additive having the polydiene structure is 1 to 10 parts by mass with respect to 100 parts by mass of the binder resin.

8. The toner for electrostatic-image development according to claim 1, wherein the release agent is a fatty acid ester compound having a number average molecular weight (Mn) of 500 to 1500.

9. The toner for electrostatic-image development according to claim 2, wherein a storage modulus G'(100) of the color resin particle at 100° C., which is determined by dynamic viscoelasticity measurement, is $1.0\times10^5$ to $3.0\times10^5$ Pa.

10. The toner for electrostatic-image development according to claim 2, wherein a ratio G'(60)/G'(100) of the storage modulus G'(60) at 60° C. to a storage modulus G'(100) at 100° C., which is determined by dynamic viscoelasticity measurement, is $1.0\times10^3$ to $5.0\times10^3$.

11. The toner for electrostatic-image development according to claim 2, wherein a content ratio of the aromatic vinyl monomer unit in the conjugated diene-aromatic vinyl-based thermoplastic elastomer is 10 to 30% by mass with respect to the total monomer unit.

12. The toner for electrostatic-image development according to claim 2, wherein a content of the additive having the polydiene structure is 1 to 10 parts by mass with respect to 100 parts by mass of the binder resin.

13. The toner for electrostatic-image development according to claim 2, wherein the release agent is a fatty acid ester compound having a number average molecular weight (Mn) of 500 to 1500.

* * * * *